US010011391B2

(12) United States Patent
Deckers et al.

(10) Patent No.: US 10,011,391 B2
(45) Date of Patent: Jul. 3, 2018

(54) BOTTLES WITH MEANS TO PREVENT GUSHING

(71) Applicant: KATHOLIEKE UNIVERSITEIT LEUVEN, Leuven (BE)

(72) Inventors: Sylvie Deckers, Olne (BE); Guy Derdelinckx, Florenville (BE); Mohammadreza Khalesi, Heverlee (BE); David Santi Riveros Galan, Ghent (BE); Zahra Shokribousjein, Kessel-Lo (BE); Hubert Verachtert, Oud-Heverlee (BE); Johan Martens, Huldenberg (BE); Pieter Verlooy, Grimbergen (BE); Sam Smet, Lovenjoel (BE)

(73) Assignee: KATHOLIEKE UNIVERSITEIT LEUVEN, Leuven (BE)

( * ) Notice: Subject to any disclaimer, the term of this patent is extended or adjusted under 35 U.S.C. 154(b) by 0 days.

(21) Appl. No.: 14/669,386

(22) Filed: Mar. 26, 2015

(65) Prior Publication Data

US 2015/0197371 A1 Jul. 16, 2015

Related U.S. Application Data

(63) Continuation-in-part of application No. PCT/BE2013/000049, filed on Sep. 26, 2013.

(60) Provisional application No. 61/706,058, filed on Sep. 26, 2012.

(51) Int. Cl.
*B65D 23/02* (2006.01)
*B65D 1/02* (2006.01)

(52) U.S. Cl.
CPC ..... *B65D 23/02* (2013.01); *B65D 1/0207* (2013.01)

(58) Field of Classification Search
CPC ..... B65D 23/02; B65D 1/0207
USPC ..... 215/12.2
See application file for complete search history.

(56) References Cited

U.S. PATENT DOCUMENTS 3,047,417 A 7/1962 Melrose
3,598,269 A * 8/1971 Carmen ..... C03C 17/328 215/12.2
4,171,056 A 10/1979 Hannon et al.
(Continued)

FOREIGN PATENT DOCUMENTS

CN 201016040 Y 2/2008
CN 201052872 Y 4/2008
(Continued)

OTHER PUBLICATIONS

Hippeli et al., "Minireview: Are Hydrophobins and/or Non-Specific Lipid Transfer Proteins Responsible for Gushing in Beer? New Hypotheses on the Chemical Nature of Gushing Inducing Factors," Z. Naturforsch, 2002, pp. 1-8, vol. 57c.
(Continued)

*Primary Examiner* — Andrew T Kirsch
*Assistant Examiner* — Jennifer Castriotta
(74) *Attorney, Agent, or Firm* — Workman Nydegger

(57) ABSTRACT

The present invention relates to hydrophobic coating of hydrophilic bottles for carbonated beverages to prevent gushing, in particular to hydrophobic coating of the bottle neck of a glass bottle. The invention also relates to a method to apply such hydrophobic coating to the inner surface of the glass bottle neck.

18 Claims, 6 Drawing Sheets

(56) References Cited

U.S. PATENT DOCUMENTS

| | | | | |
|---|---|---|---|---|
| 4,311,250 | A * | 1/1982 | Ravve | B05D 7/22 215/12.2 |
| 6,036,054 | A | 3/2000 | Grill | |
| 6,345,729 | B1 | 2/2002 | Santy, Jr. | |
| 6,599,594 | B1 * | 7/2003 | Walther | C03C 17/22 215/12.2 |
| 7,052,725 | B2 | 5/2006 | Chang et al. | |
| 7,296,508 | B2 | 11/2007 | Hillyer | |
| 2002/0028304 | A1 * | 3/2002 | Slat | B05D 1/62 427/575 |
| 2005/0224425 | A1 * | 10/2005 | Patton | A01N 25/10 210/767 |
| 2005/0262813 | A1 * | 12/2005 | Michalsky | B65D 11/04 53/473 |
| 2009/0285965 | A1 | 11/2009 | Liu | |
| 2011/0226658 | A1 * | 9/2011 | Tata-Venkata | A61J 1/00 206/524.1 |
| 2012/0142795 | A1 | 6/2012 | Varanasi et al. | |

FOREIGN PATENT DOCUMENTS

| | | | |
|---|---|---|---|
| CN | 201099613 | Y | 8/2008 |
| JP | 2810694 | B2 | 10/1998 |
| JP | 3048499 | B2 | 6/2000 |
| JP | 3048501 | B2 | 6/2000 |
| JP | 2001293344 | A | 10/2001 |
| JP | 2003112796 | A | 4/2003 |
| JP | 2006020985 | A | 1/2006 |
| WO | 2005047166 | A1 | 5/2005 |

OTHER PUBLICATIONS

International Search Report for corresponding International PCT Application No. PCT/BE2013/000049, dated Feb. 3, 2014.

Kastner, "Gushing of Malt Beer," Wochenschrift fur Brauerei (Brewery Weekly), Mar. 1909, pp. 169-170, vol. 26.

Sharaf et al., "Comparative Investigations on the Efficiency of Different Anchoring Chemicals for the Permanent Finishing of Cotton with Chitosan," AUTEX Research Journal, Jun. 2011, pp. 71-77, vol. 11, No. 2.

"Brewery," Orval, retrieved from http://www.orval.be/en/8/Brewery, Jan. 30, 2018, pp. 1-5.

"Brewing," Wikipedia, retrieved from https://en.wikipedia.org/wiki/Brewing, Jan. 30, 2018, pp. 1-16.

"Duvel (beer)," Wikipedia, retrieved from https://nl.wikipedia.org/wiki/Duvel_(bier), Jan. 30, 2018, pp. 1-4.

"Orval (beer)," Wikipedia, retrieved from https://nl.wikipedia.org/wiki/Orval_(bier), Jan. 30, 2018, pp. 1-4.

"Sparkling Wine," Wikipedia, retrieved from https://en.wikipedia.org/wiki/Sparkling_wine, Jan. 30, 2018, pp. 1-20.

"Top Fermentation Refermented in the Bottle," Belgian Happiness, retrieved from https://www.belgianhappiness.com/en/more-info/fermentation/top-fermentation-refermented-in-the-bottle, Jan. 30, 2018, pp. 1-2.

* cited by examiner

BOTTLES WITH MEANS TO PREVENT GUSHING

FIELD OF THE INVENTION

The present invention generally relates to hydrophilic bottles such as glass bottles for carbonated aqueous liquid, e.g. a carbonated beverage, for instance a beer or a beer like beverage. More particularly it relates to a hydrophobic coating of the bottle neck to inhibit or prevent gushing of liquid when opening the bottle, and to a manufacturing method for the hydrophobic coating the bottle neck. The invention also relates to rendering the surface hydrophobic or hydrophobic coating of the neck of a glass bottle, e.g. of a beer bottle or of a bottle for a carbonated beverage, for instance a beer or a beer like beverage, a sparkling wine, a cider, a sparkling juice or other sparkling beverages consisting partially or totally by a potential substrate containing substances provoking primary gushing.

BACKGROUND OF THE INVENTION

Gushing is the spontaneous and wild overfoaming of carbonated beverage after opening the bottle and without shaking (Kastner, H., 1909. Das "Wildwerden" des Malzbieres. *Wochenschrift für Brauerei* 26, 169-170). Gushing is due to the presence of Class II hydrophobins, fungal hydrophobins, hydrophobic components of conidiospores or aerial mycelia [Hippeli, S, and Elsner, E. F. (2002). *Z. Naturforsch.* 57c, 1-8]. Hydrophobins are strong surface-active proteins able to form and stabilize gaseous $CO_2$ nanobubble by forming a crystalline layer around the nanobubble. This nanobubble formation can be enhanced by a hydrophilic glass wall at the interface. These nanobubbles are created throughout the volume of beer and ascend quickly under foam formation, which flows out of the bottle. Gushing represents bad brand image and economic problems for the producers in the brewing industry as it is only observed at the bottle opening of the final product.

DESCRIPTION OF THE RELATED ART

U.S. Pat. No. 3,047,417 discloses a process of rendering glass bottles dripless comprising the steps of (1) applying a continuous film of an undiluted, non-volatile, high molecular weight dimethyl-polysiloxane fluid on the sealing surface of a glass bottle, which is at room temperature, and the exterior portion of the finish immediately adjacent thereto, (2) applying an open flame directly onto the so treated area of the bottle for a period of less than 10 seconds to rapidly raise the skin temperature of the so treated area of the bottle to at least 175° F., but not greater than 350° F. thereby curing said fluid, said fluid, prior to said application, having a viscosity in the range of 1000 to 100,000 centistokes at 25° C.

U.S. Pat. No. 4,171,056 discloses a glass container coated on its outer surface to prevent the scattering of glass fragments which comprises (A) a glass container, (B) an inner smooth non-particulate coating initially applied to (A) as non-tacky composite powder particles intimately contacted on the external wall surface of said container said composite powder particles comprising (a) tacky powder particles comprising a mixture of (1) a block copolymer which is either unhydrogenated or selectively hydrogenated to at least some degree and having at least two kinds of polymer blocks wherein one polymer block is designated by A and a second polymer block is designated by B such that prior to hydrogenation, (a) each A is a polymer end block of a monovinyl or alpha alkyl monovinyl arene having a number average molecular weight in the range of from about 5,000 to about 75,000, said blocks A comprising from about 5 to about 50% by weight of the total block copolymer, and (b) each B is a polymer mid block having a number average molecular weight of from about 30,000 to about 300,000, and formed from a conjugated diene selected from homopolymers of at least one conjugated diene having 4 to 10 carbon atoms per molecule, said blocks B comprising from about 50 to about 95% by weight of the total block copolymer, (2) at least one melt flow modifier selected from the group consisting of (a) monovinyl arene homopolymers, (b) alpha alkyl monovinyl arene homopolymers, and (c) copolymers of monovinyl arenes and alpha alkyl monovinyl arenes, wherein the aromatic portions of the polymers described (2) (a), (b) and (c) are at least partially hydrogenated to remove the aromatic character thereof, and (3) at least one adhesion promoter, and (b) smaller solid particles, which are hard and non-tacky and which comprise at least one melt flow modifier of the group described in (a) (2) with the provision that the melt flow modifier have a glass transition temperature of at least about 20° C., adhering to the tacky surface of said tacky particles of (a) in a non-continuous layer, said composite powder particles being rendered in the configuration of a smooth non-particulate inner coating of the external surface of the glass container by heat and, (c) an outer top coat of a synthetic resin covering substantially the entire outer surface of said inner coat and a part of the external glass container surface and selected from the group consisting of epoxy resins, polyurethanes, polycarbonates, polyesters, polystyrenes, ethylene/vinyl acetate copolymers and acrylic homopolymers and copolymers wherein the outer film has high abrasion resistance, wet and dry scratch resistance, water resistance, chemical resistance, oil resistance, and weather resistance.

U.S. Pat. No. 6,345,729 discloses a beverage dispensing nozzle, comprising: a cap member comprising a first beverage syrup inlet port coupled to a first beverage syrup source and a mixing fluid inlet port coupled to a mixing fluid source; a first annulus coupled with the cap member, the first annulus including discharge channels, wherein the first beverage syrup inlet port communicates beverage syrup to the discharge channels for discharge from the beverage dispensing nozzle substantially undiluted with mixing fluid; and an outer housing coupled to the cap member, the outer housing and the first annulus defining a mixing fluid channel, wherein the mixing fluid inlet port communicates mixing fluid to the mixing fluid channel for discharge from the beverage dispensing nozzle for contact with exiting beverage syrup to mix therewith outside the beverage dispensing nozzle.

Prior art related to the prevention of beer foam production mainly comprise addition of extra devices to the existing bottles such as a bottled beer foam destroyer (CN201052872Y), devices for pouring beer without foam formation (CN201099613Y, WO2005047166A1), or a detachable gauze to prevent foam leaking when opening the bottle (CN20106040Y).

SUMMARY OF THE INVENTION

However there remains a need in the art to prevent such gushing without use of additives or of extra utensils.

The present invention provides a solution to the problem by changing the inner surface properties of the bottle neck, in particular by providing such with a hydrophobic, preferably super hydrophobic property. The gushing problem is solved by hydrophobic or super-hydrophobic coating of the bottle neck. This technical effect particularly distinct in hydrophobin containing beverages, such as beer, whereby the interaction between the hydrophilic glass wall and the Class II hydrophobins that induce the formation of the stabilized nanobubbles and foam production is inhibited or prevented. The overfoaming problem of carbonated liquids is solved by hydrophobic or super-hydrophobic coating of the bottle neck. This technical effect particularly distinct in carbonated liquids, such as for example: beer or cider or natural mineral water or soda or champagne or sparkling wine, containing traces of hydrophobic or especially amphiphilic organic compounds originating especially from fungi or soil organisms whereby the interaction between the hydrophilic glass wall and the hydrophobic or especially amphiphilic organic compounds induce the formation of the stabilized nanobubbles and foam production, is inhibited or prevented.

According to a first aspect of the present invention a glass bottle is provided, said glass bottle comprising a neck [2], shoulder [3] and body [4]; a sealable opening at the end of or above the neck [2] and comprising optionally a finish [1], wherein the bottle comprises a hydrophobic layer, coating or film, formed within or on surface of the glass of at least in part the inner surface of the neck [2] or shoulder [3] of the bottle, said hydrophobic layer, coating or film inhibiting or preventing gushing of a carbonated aqueous liquid when opening said bottle filled with said carbonated aqueous liquid, said hydrophobic layer, coating or film in contactable with a surface (border between gas phase and liquid phase) of said carbonated aqueous liquid constituting an anti-gushing zone.

According to a second aspect of the present invention a glass bottle is provided, said glass bottle comprising a neck [2] shoulder [3] and body [4]; and a sealable opening at the end of or above the neck [2] and comprising optionally a finish [1], wherein the bottle comprises a hydrophobic layer, a hydrophobic coating or a hydrophobic film, formed within or on surface of the glass of at least in part the inner surface of the neck [2] and or shoulder [3] of the bottle, said hydrophobic layer, coating or film inhibiting or preventing gushing of a carbonated aqueous liquid at opening of said bottle filled with a carbonated aqueous liquid, that part of said hydrophobic layer, coating or film contactable with a surface (border between gas phase and liquid phase) of said carbonated aqueous liquid constituting an anti-gushing zone.

According to a third aspect of the present invention a glass bottle is provided, said glass bottle comprising a neck [2], shoulder [3] and body [4]; a sealable opening at the end of or above the neck [2] and comprising optionally a finish [1], wherein the bottle comprises an anti-gushing zone for inhibiting or preventing gushing of a carbonated aqueous liquid when opening the bottle filled with said carbonated aqueous liquid and that the anti-gushing zone comprises a hydrophobic layer, a hydrophobic coating or a hydrophobic film, formed within or on surface of the glass of at least in part the inner surface of the neck [2] or shoulder [3] of the bottle.

According to a fourth aspect of the present invention a glass bottle is provided, said glass bottle comprising a neck [2] shoulder [3] and body [4]; and a sealable opening at the end of or above the neck [2] and comprising optionally a finish [1], wherein the bottle comprises an anti-gushing zone for inhibiting or preventing gushing of a carbonated aqueous liquid at opening of said bottle and that the anti-gushing zone consists of a hydrophobic layer, a hydrophobic coating or a hydrophobic film, formed within or on surface of the glass of at least in part the inner surface of the neck [2] and or shoulder [3] of the bottle.

According to one embodiment the present invention concerns a hydrophilic container for liquid, preferably a glass container for liquid with the shape of a bottle with an elongated section at its top, preferably shaped as a hollow cylinder or rod, whereby the inner section of this elongated section is covered by a hydrophobic layer (for example polypropylene) or is rendered at its surface hydrophobic at least in this inner part of the elongated section to form an inner hydrophobic zone in the hydrophilic glass container for liquid, so that when filled by a carbonated aqueous liquid, e.g. a carbonated beverage, for instance a sparkling water, a beer, a beer like beverage, a sparkling mix of fruit juices with or without water, cider or champagne, the surface of this liquid is at the level of this hydrophobic zone.

In a further embodiment of the invention, the invention concerns a hydrophilic container for liquid, preferably a glass container for liquid with the shape of a bottle with an elongated section at its top, preferably shaped as a hollow cylinder or rod, whereby the inner section of this elongated section is covered by a hydrophobic layer (for example polypropylene) or is rendered at its surface hydrophobic at least in this inner part of the elongated section to form an inner hydrophobic zone in the hydrophilic glass container for liquid so that when filled by a carbonated aqueous liquid, e.g. a carbonated beverage, for instance sparkling water, a beer, a beer like beverage, cider or champagne, the edge of the liquid surface contacts the hydrophobic zone.

In yet another further embodiment of the invention concerns a hydrophilic container for liquid, preferably a glass container for liquid with the shape of a bottle with an elongated section at its top, preferably shaped as a hollow cylinder or rod, whereby the inner section of this elongated section is covered by a hydrophobic layer (for example polypropylene) or is rendered at its surface hydrophobic at least in this inner part of the elongated section to form an inner hydrophobic zone in the hydrophilic glass container for liquid so that when filled by a carbonated aqueous liquid, e.g. a carbonated beverage, for instance sparkling water, a beer, a beer like beverage, cider or champagne, the edge of the liquid surface contacts the hydrophobic zone and the hydrophobic zone is at least 5 mm above the liquid surface and at least one 5 mm under the liquid surface and preferably is at least one cm above the liquid surface and at least one cm under the liquid surface.

In the above embodiments the glass container for liquid has a hydrophilicity that is verifiable as such: the base glass where it is not covered by a hydrophobic layer or where it is not rendered hydrophobic and where it is flattened is such that water forms a contact angle of less than 30°, preferably 11° to 12.8°, more preferably 11.5° to 12.5°, yet more preferably of 11.8° to 12°.

In one embodiment, the invention provides a hydrophilic container for liquid with a neck [2], a body [4] and a base [6] and a sealable opening at the end of or above the neck [2] whereby the inner surface of this neck [2] is at least in part hydrophobic or has a hydrophobic property or whereby the inner surface of this neck [2] is at least in part super-hydrophobic or has a super-hydrophobic property.

In another embodiment, the invention provides a bottle shape hydrophilic container for liquid comprising a narrower hollow upper elongated section with opening, whereby the inner surface of said elongated section locoregional is hydrophobic or has a hydrophobic property or this elongated section locoregional is super-hydrophobic or has a super-hydrophobic property.

These bottles of present invention are particularly suitable for carbonated beverages as they prevent gushing at opening in particularly after energy has been introduced by movement or vibration of said bottles.

In another embodiment of any of the above embodiments, the hydrophobic surface in the neck [2] or in the inner part of the elongated section forms a hydrophobic zone in the hydrophilic glass container for liquid so that when filled by a carbonated aqueous liquid the surface of this liquid is at the level of this hydrophobic zone. In a preferred embodiment, the invention provides a container for liquid, whereby the hydrophobic surface in the neck [2] or in the inner part of the elongated section forms a hydrophobic zone in the hydrophilic glass container for liquid so that when filled by a carbonated aqueous liquid, e.g. a carbonated beverage, for instance a beer or a beer like beverage, the edge of the liquid surface contacts the hydrophobic zone. In another preferred embodiment, the invention provides a container for liquid, whereby the hydrophobic surface in the neck [2] or in the inner part of the elongated section forms a hydrophobic zone in the hydrophilic glass container for liquid so that when filled by a carbonated aqueous liquid, e.g. a carbonated beverage, for instance a beer or a beer like beverage, the edge of the liquid surface contacts the hydrophobic zone and the hydrophobic zone is at least 5 mm above the liquid surface and at least one 5 mm under the liquid surface and preferably is at least one cm above the liquid surface and at least one cm under the liquid surface.

The hydrophobic surface or hydrophobic coating of present invention in the bottle of present invention can in a particular embodiment be applied at or to the inner surface parts of the bottle selected from the group consisting of the bottle finish and shoulder. The hydrophobic surface or hydrophobic coating of present invention in a glass bottle of present invention is in a particular embodiment applied at or to the inner surface of the bottle.

In another embodiment of any of the above embodiments, the invention provides a container for liquid, whereby said hydrophobic part comprises trimethylsiloxane, dimethylsiloxane, diphenylsiloxane, methylphenylsiloxane and/or dialkylsiloxane groups, and/or polyethylene, poly(vinyl chloride), poly(vinylidene fluoride), polydimethylsiloxane, polydialylsiloxane, polymethylphenylsiloxane, polydiphenylsiloxane and/or chlorinated polypropylene and/or surface treatment with glycidyloxypropyltrimethoxysilane, oligosiloxysilane, and/or oligosiloxysiloxane, with said hydrophobic part comprising polyethylene, polyvinyl chloride, poly (vinylidene fluoride) and/or chlorinated polypropylene and/or surface treatment with glycidyloxypropyltrimethoxysilane being preferred. In yet another embodiment of any of the above embodiments, the invention provides a container for liquid, whereby the hydrophobic coating is selected from the group consisting of trimethylsiloxane, dimethylsiloxane, diphenylsiloxane, methylphenylsiloxane and dialkylsiloxane groups and polyethylene, poly(vinyl chloride), poly(vinylidene fluoride), polydimethylsiloxane, polydialkylsiloxane, polymethylphenylsiloxane, polydiphenylsiloxane and chlorinated polypropylene and surface treatment with glycidyloxypropyltrimethoxysilane, oligosiloxysilanes and oligosiloxysiloxanes, with said hydrophobic part being preferably selected from polyethylene, polyvinyl chloride, poly (vinylidene fluoride), chlorinated polypropylene and surface treatment with glycidyloxypropyltrimethoxysilane. In a preferred embodiment, the invention provides a container for liquid according to any one of the above embodiments, whereby said hydrophobic part comprises glycidyloxypropyltrimethoxysilane. In another preferred embodiment, the invention provides a container for liquid according to any one of the above embodiments, whereby said hydrophobic part comprises polyethylene. In another preferred embodiment, the invention provides a container for liquid according to any one of the above embodiments, whereby said hydrophobic part comprises poly(vinyl chloride). In another preferred embodiment, the invention provides a container for liquid according to any one of the above embodiments, whereby said hydrophobic part comprises poly(vinylidene fluoride). In yet another preferred embodiment, the invention provides a container for liquid according to any one of the above embodiments, whereby said hydrophobic part comprises surface treatment with an oligosiloxysilane. In yet another preferred embodiment, the invention provides a container for liquid according to any one of the above embodiments, whereby said hydrophobic part comprises treatment with an oligosiloxysiloxane. In yet another preferred embodiment, the invention provides a container for liquid according to any one of the above embodiments, whereby said hydrophobic part comprises trimethylsiloxane groups. In yet another preferred embodiment, the invention provides a container for liquid according to any one of the above embodiments, whereby said hydrophobic part comprises dimethylsiloxane groups. In yet another preferred embodiment, the invention provides a container for liquid according to any one of the above embodiments, whereby said hydrophobic part comprises methylphenylsiloxane groups. In yet another preferred embodiment, the invention provides a container for liquid according to any one of the above embodiments, whereby said hydrophobic part comprises diphenylsiloxane groups. In yet another preferred embodiment, the invention provides a container for liquid according to any one of the above embodiments, whereby said hydrophobic part comprises dialkylsiloxane. In yet another preferred embodiment, the invention provides a container for liquid according to any one of the above embodiments, whereby said hydrophobic part comprises polydialkylsiloxane. In yet another preferred embodiment, the invention provides a container for liquid according to any one of the above embodiments, whereby said hydrophobic part comprises polydimethylsiloxane. In yet another preferred embodiment, the invention provides a container for liquid according to any one of the above embodiments, whereby said hydrophobic part comprises polymethylphenylsiloxane. In yet another preferred embodiment, the invention provides a container for liquid according to any one of the above embodiments, whereby said hydrophobic part comprises polydiphenylsiloxane. In yet another preferred embodiment, the invention provides a container for liquid according to any one of the above embodiments, whereby said hydrophobic part comprises chlorinated polypropylene.

In another embodiment of any of the above embodiments, the invention provides a container for liquid, whereby the carbonated aqueous liquid is a carbonated beverage. In a preferred embodiment, the invention provides a container for liquid according to any one of the previous embodiments, whereby the carbonated aqueous liquid is a beer. In another preferred embodiment, the invention provides a container for liquid according to any one of the above embodiments, whereby the carbonated aqueous liquid is beer like beverage.

In another embodiment of any of the above embodiments, the invention provides a container for liquid, whereby such inner surface or inner surface part is made hydrophobic or super-hydrophobic by spraying, dipping, or a contact application method. In another embodiment of any of the above embodiments, the invention provides a container for liquid, whereby such inner surface or inner surface part is made hydrophobic or super-hydrophobic through the use of a gas phase deposition method. In another embodiment of any of the above embodiments, the invention provides a container for liquid, whereby such inner surface or inner surface part is made hydrophobic or super-hydrophobic through atomic layer deposition. In a preferred embodiment, the invention provides a container for liquid according to any one of the above embodiments, whereby such inner surface or inner surface part is made hydrophobic or super-hydrophobic by dipping the bottle neck or part of the bottle neck in a solution containing a hydrophobic or a super-hydrophobic coating compound.

Another aspect of present concerns the use of the container for liquid according to any one of the above embodiments, for inhibiting or preventing gushing when dispensing carbonated aqueous liquid. A particular aspect of present invention concerns the use of the container for liquid according to any one of the above embodiments, for inhibiting or preventing gushing when dispensing carbonated beverage. In another preferred embodiment, the invention provides the use of the container for liquid according to any one of the above embodiments, for inhibiting or preventing gushing when dispensing carbonated aqueous solution. In another preferred embodiment, the invention provides the use of the container for liquid according to any one of the above embodiments, for inhibiting or preventing gushing when dispensing carbonated soda. In another preferred embodiment, the invention provides the use of the container for liquid according to any one of the above embodiments, for inhibiting or preventing gushing when dispensing carbonated water. In another preferred embodiment, the invention provides the use of the container for liquid according to any one of the above embodiments, for inhibiting or preventing gushing when dispensing cider like beverage. In another preferred embodiment, the invention provides the use of the container for liquid according to any one of the above embodiments, for inhibiting or preventing gushing when dispensing champagne like beverage. In another preferred embodiment, the invention provides the use of the container for liquid according to any one of the above embodiments, for inhibiting or preventing gushing when carbonated wine like beverage. In another preferred embodiment, the invention provides the use of the container for liquid according to any one of the above embodiments, for inhibiting or prevent gushing when dispensing cider. In another preferred embodiment, the invention provides the use of the container for liquid according to any one of the above embodiments, for inhibiting or prevent gushing when dispensing champagne. In another preferred embodiment, the invention provides the use of the container for liquid according to any one of the above embodiments, for inhibiting or prevent gushing when dispensing beer like beverage. In yet another preferred aspect, the invention provides the use of the container for liquid according to any one of the above embodiments, for inhibiting or prevent gushing when dispensing beer.

A particular embodiment of present invention concerns an antigushing zone comprising a hydrophobic thin layer, a hydrophobic thin film, an ultrathin hydrophobic layer or an ultrathin hydrophobic film formed within or on surface of the glass of at least part of the internal part of a bottle. This antigushing zone can be formed by hydrophobic coating or upon deposition of a hydrophobic treatment composition. Such antigushing zone is formed within or on the surface of glass as a fixed layer, coating or film that does not lose its hydrophobicity and does not detach in contact with carbonated aqueous liquids under standard storage conditions. It is not a removable plug. The hydrophobic part in the bottle of present invention is not a removable plug, cap or spout to prevent liquid dripping during the pouring process. Such plugs can be introduced in a bottle after opening of said bottle to obtain the technical effect of preventing spilling or dripping when the beverage is poured out the bottle for instance into a drinking glass or a drinking cup. Preferably the antigushing zone within or on surface of glass inside the bottle of present invention does not cover the entire inner surface of the glass bottle. The best antigushing effect for bottles that can be stored while standing or while lying is obtained when at least that surface is hydrophobic that contacts the edge of the surface of the stored carbonated beverage. It is for instance sufficient that the antigushing zone extend above and under the surface (border between gas phase and liquid phase).

A particular embodiment of the present invention concerns an antigushing zone comprising a hydrophobic thin layer, a hydrophobic thin film, an ultrathin hydrophobic layer or an ultrathin hydrophobic film formed within or on the whole of the inner surface of the glass bottle.

In a particular preferred embodiment of present invention the container for liquid in any of the above embodiments, is glass container for liquid.

Some embodiments of the invention are set forth in claim format directly below:

1. A method for inhibiting or preventing of gushing when dispensing carbonated aqueous liquids from a hydrophilic container comprising a finish [1], a neck [2] or a shoulder [3], and a sealable opening at the end of or above the neck [2]; characterized by applying a hydrophobic coating to at least a part of the inner surface of the finish [1], the neck [2] or the shoulder [3] of the hydrophilic container.

2. The method according to embodiment 1, wherein the hydrophobic coating is not a removable hydrophobic plug or spout.

3. The method according to embodiments 1 or 2, wherein the hydrophobic coating is applied to at least a part of the inner surface of the neck [2] of the hydrophilic container.

4. The method according to embodiment 3, wherein the hydrophobic coating is additionally applied to the inner surface of the group consisting of the finish [1] and shoulder [3] of the hydrophilic container.

5. The method according to any one of the previous embodiments 1 to 4, wherein the hydro-phobic coating is applied to at least a part of the inner surface of the finish [1], the neck [2] or the shoulder [3] of the hydrophilic container, so that when the container is filled by the carbonated aqueous liquid the edge of the surface of this liquid contacts the hydrophobic coating.

6. The method according to any one of previous embodiments 1 to 5, wherein the hydrophobic coating is applied to at least a part of the inner surface of the finish [1], the neck [2] or the shoulder [3] of the hydrophilic container, so that when the container is filled by the carbonated aqueous liquid, the edge of the liquid surface contacts the hydrophobic coating and the hydrophobic coating is at least 5 mm above the edge of the liquid surface and at least 5 mm under the edge of the liquid surface.

7. The method according to any one of the previous embodiments 1 to 6, wherein the hydrophobic coating is applied to at least a part of the inner surface of the finish [1], the neck [2] or the shoulder [3] of the hydrophilic container, so that when the container is filled by the carbonated aqueous liquid, the edge of the liquid surface contacts the hydrophobic coating and the hydrophobic coating is at least 1 cm above the edge of the liquid surface and at least 1 cm under the edge of the liquid surface.

8. The method according to any one of the previous embodiments 1 to 7, wherein the hydrophobic coating is applied to the inner surface of the hydrophilic container at least 1 cm under the cap of the bottle.

9. The method according to any one of the previous embodiments 1 to 8, wherein the hydrophobic coating is applied to a glass-based container.

10. The method according to any one of the previous embodiments 1 to 9, wherein the hydrophilic container is a glass container for liquid.

11. The method according to embodiment 10, wherein the glass container for liquid is a glass bottle.

12. The method according to embodiment 9 to 11, wherein the hydrophobic coating is applied to the whole inner surface of the container.

13. The method according to any one of the previous embodiments 1 to 12, wherein the hydrophobic coating comprises trimethylsiloxane, dimethylsiloxane, diphenylsiloxane and/or methylphenylsiloxane groups, and/or polyethylene, poly(vinyl chloride), poly(vinylidene fluoride), polydimethylsiloxane, polymethylphenylsiloxane, polydiphenylsiloxane and/or chlorinated polypropylene and/or surface treatment with glycidyloxypropyltrimethoxysilane, an oligosiloxysilane and/or an oligosiloxysiloxane.

14. The method according to any one of the previous embodiments 1 to 12, wherein the hydrophobic coating is selected from the group consisting of trimethylsiloxane, dimethylsiloxane, dialkylsiloxane, diphenylsiloxane and methylphenylsiloxane groups; and polyethylene, poly(vinyl chloride), poly(vinylidene fluoride), polydimethylsiloxane, polydialkylsiloxane, polymethylphenylsiloxane, polydiphenylsiloxane and chlorinated polypropylene; and surface treatment with glycidyloxypropyltrimethoxysilane, oligosiloxysilanes and oligosiloxysiloxanes.

15. The method according to any one of the previous embodiments 1 to 12, wherein the hydrophobic coating comprises surface treatment with glycidyloxypropyltrimethoxysilane.

16. The method according to any one of the previous embodiments 1 to 12, wherein the hydrophobic coating comprises polyethylene.

17. The method according to any one of the previous embodiments 1 to 12, wherein the hydrophobic coating comprises poly(vinyl chloride).

18. The method according to any one of the previous embodiments 1 to 12, wherein the hydrophobic coating comprises poly(vinylidene fluoride).

19. The method according to any one of the previous embodiments 1 to 12, wherein the hydrophobic coating comprises chlorinated polypropylene.

20. The method according to any one of the previous embodiments 1 to 12, wherein the hydrophobic coating comprises surface treatment with an oligosiloxysilane.

21. The method according to any one of the previous embodiments 1 to 12, wherein the hydrophobic coating comprises surface treatment with an oligosiloxysiloxane.

22. The method according to any one of the previous embodiments 1 to 12, wherein the hydrophobic coating comprises dialkylsiloxane groups.

23. The method according to any one of the previous embodiments 1 to 12 wherein the hydrophobic coating comprises dimethylsiloxane groups.

24. The method according to any one of the previous embodiments 1 to 12 wherein the hydrophobic coating comprises trimethylsiloxane groups.

25. The method according to any one of the previous embodiments 1 to 12, wherein the hydrophobic coating comprises polydialkylsiloxane.

26. The method according to any one of the previous embodiments 1 to 12, wherein the hydrophobic coating comprises polydimethylsiloxane.

27. The method according to any one of the previous embodiments 1 to 12, wherein the hydrophobic coating comprises methylphenylsiloxane groups.

28. The method according to any one of the previous embodiments 1 to 12, wherein the hydrophobic coating comprises polymethylphenylsiloxane.

29. The method according to any one of the previous embodiments 1 to 12, wherein the hydrophobic coating comprises diphenylsiloxane groups.

30. The method according to any one of the previous embodiments 1 to 12, wherein the hydrophobic coating comprises polydiphenylsiloxane.

31. The method according to any one of the previous embodiments 1 to 28, wherein the carbonated aqueous liquid is a carbonated beverage.

32. The method according to any one of the previous embodiment 31, wherein the carbonated aqueous liquid is a carbonated water.

33. The method according to any one of the previous embodiment 31, wherein the carbonated aqueous liquid is a carbonated aqueous solution.

34. The method according to any one of the previous embodiment 31, wherein the carbonated aqueous liquid is a carbonated cider like beverage.

35. The method according to any one of the previous embodiment 31, wherein the carbonated aqueous liquid is a carbonated cider.

36. The method according to any one of the previous embodiment 31, wherein the carbonated aqueous liquid is a carbonated champagne.

37. The method according to any one of the previous embodiment 31, wherein the carbonated aqueous liquid is a carbonated champagne like beverage.

38. The method according to any one of the previous embodiment 31, wherein the carbonated aqueous liquid is a carbonated wine like beverage.

39. The method according to embodiment 29, wherein the carbonated beverage is a beer.

40. The method according to embodiment 29, wherein the carbonated beverage is beer like beverage.

41. The method according to any one of the previous embodiments 1 to 40, wherein the hydrophobic coating of at least a part of the inner surface of the finish [1], the neck [2] or the shoulder [3] of the hydrophilic container, is applied by spraying, dipping, or a contact application method.

42. The method according to any one of the previous embodiments 1 to 40, wherein the hydrophobic coating of at least a part of the inner surface of the finish [1], the neck [2] or the shoulder [3] of the hydrophilic container is applied by dipping the finish [1], the neck [2] or the shoulder [3] in a solution containing a hydrophobic coating.

43. The method according to any one of the previous embodiments 1 to 40, wherein the hydrophobic coating of at least a part of the inner surface of the finish [1], the neck [2] or the shoulder [3] of the hydrophilic container is through a gas phase deposition process.

44. The method according to any one of the previous embodiments 1 to 40, wherein the hydrophobic coating of at least a part of the inner surface of the finish [1], the neck [2] or the shoulder [3] of the hydrophilic container is applied by atomic layer deposition.

Some other embodiments of the invention are set forth in claim format directly below:

1. A hydrophilic container for liquid with a neck [2], a body [4] and a base [6] and a sealable opening at the end of or above the neck [2] wherein the inner surface of this neck [2] is at least in part hydrophobic or has a hydrophobic property.

2. The container according to embodiment 1 wherein the inner surface of this neck [2] is at least in part super-hydrophobic or has a super-hydrophobic property.

3. A bottle shape hydrophilic container for liquid comprising a narrower hollow upper elongated section with opening, wherein the inner surface of said elongated section locoregional is hydrophobic or has a hydrophobic property.

4. The container according to 3, wherein the inner surface of said elongated section locoregional is super-hydrophobic or has a super-hydrophobic property.

5. The container according to any one of the previous embodiments 1 to 4, whereby the liquid is a carbonated beverage.

6. The container according to any one of the previous embodiments 1 to 4, whereby the hydrophobic surface in the neck [2] or in the inner part of the elongated section forms a hydrophobic zone in the hydrophilic glass container for liquid so that when filled by a carbonated aqueous liquid the surface of this liquid is at the level of this hydrophobic zone.

7. The container according to any one of the previous embodiments 1 to 4, whereby the hydrophobic surface in the neck [2] or in the inner part of the elongated section forms a hydrophobic zone in the hydrophilic glass container for liquid so that when filled by a carbonated aqueous liquid, e.g. a carbonated beverage, for instance carbonated water, carbonated soda, cider, a cider-like beverage, sparking wine, carbonated wine-like beverage, a beer or a beer like beverage, the edge of the liquid surface contacts the hydrophobic zone.

8. The container according to any one of the previous embodiments 1 to 4, whereby the hydrophobic surface in the neck [2] or in the inner part of the elongated section forms a hydrophobic zone in the hydrophilic glass container for liquid so that when filled by a carbonated aqueous liquid, e.g. a carbonated beverage, for instance carbonated water, carbonated soda, cider, a cider-like beverage, sparking wine, carbonated wine-like beverage, a beer or a beer like beverage, the edge of the liquid surface contacts the hydrophobic zone and the hydrophobic zone is at least 5 mm above the liquid surface and at least one 5 mm under the liquid surface and preferably is at least one cm above the liquid surface and at least one cm under the liquid surface.

9. The container according to any one of the previous embodiments 1 to 8, whereby said hydrophobic surface is further on or said hydrophobic coating is further applied to the inner surface parts of the bottle selected from the group consisting of the bottle finish and shoulder.

10. The container according to any one of the previous embodiments 1 to 9, whereby the container is a glass container for liquid.

11. The container according to embodiment 10, whereby said hydrophobic surface is applied to the whole inner surface of the bottle.

12. The container according to any one of the previous embodiments 1 to 11, whereby said hydrophobic part comprises trimethyl siloxane, dimethylsiloxane, diphenylsiloxane and/or methylphenylsiloxane groups; and/or polyethylene, poly(vinyl chloride), poly(vinylidene fluoride), polydimethylsiloxane, polymethylphenylsiloxane, polydiphenylsiloxane and/or chlorinated polypropylene; and/or surface treatment with glycidyloxypropyltrimethoxysilane, an oligosiloxysilane and/or an oligosiloxysiloxane.

13. The container according to any one of the previous embodiments 1 to 11, whereby the hydrophobic coating is selected from the group consisting of polyethylene, poly (vinyl chloride), poly(vinylidene fluoride), chlorinated polypropylene and surface treatment with glycidyloxypropyltrimethoxysilane.

14. The container according to any one of the previous embodiments 1 to 11, whereby said hydrophobic part comprises surface treatment with glycidyloxypropyltrimethoxysilane.

15. The container according to any one of the previous embodiments 1 to 11, whereby said hydrophobic part comprises polyethylene.

16. The container according to any one of the previous embodiments 1 to 11, whereby said hydrophobic part comprises poly(vinyl chloride).

17. The container according to any one of the previous embodiments 1 to 11, whereby said hydrophobic part comprises poly(vinylidene fluoride).

18. The container according to any one of the previous embodiments 1 to 11, whereby said hydrophobic part comprises surface treatment with an oligosiloxysilane.

19. The container according to any one of the previous embodiments 1 to 11, whereby said hydrophobic part comprises surface treatment with an oligosiloxysiloxane.

20. The container according to any one of the previous embodiments 1 to 11, whereby said hydrophobic part comprises trimethylsiloxane groups.

21. The container according to any one of the previous embodiments 1 to 11, whereby said hydrophobic part comprises dimethylsiloxane groups.

22. The container according to any one of the previous embodiments 1 to 11, whereby said hydrophobic part comprises polydimethylsiloxane.

23. The container according to any one of the previous embodiments 1 to 11, whereby said hydrophobic part comprises diphenylsiloxane groups.

24. The container according to any one of the previous embodiments 1 to 11, whereby said hydrophobic part comprises methylphenylsiloxane groups.

25. The container according to any one of the previous embodiments 1 to 11, whereby said hydrophobic part comprises polymethylphenylsiloxane.

26. The container according to any one of the previous embodiments 1 to 11, whereby said hydrophobic part comprises polydiphenylsiloxane.

27. The container according to any one of the previous embodiments 1 to 11, whereby said hydrophobic part comprises chlorinated polypropylene.

28. The container according to any one of the previous embodiments 1 to 27, whereby the carbonated aqueous liquid is a carbonated beverage.

29. The container according to any one of the previous embodiments 1 to 27, whereby the carbonated aqueous liquid is a beer.

30. The container according to any one of the previous embodiments 1 to 27, whereby the carbonated aqueous liquid is beer-like beverage.

31. The container according to any one of the previous embodiments 1 to 27, whereby the carbonated aqueous liquid is a cider-like beverage.

32. The container according to any one of the previous embodiments 1 to 27, whereby the carbonated aqueous liquid is a wine-like beverage.

33. The container according to any one of the previous embodiments 1 to 27, whereby the carbonated aqueous liquid is champagne-like beverage.

34. The container according to any one of the previous embodiments 1 to 27, whereby the carbonated aqueous liquid is natural water-like beverage.

35. The container according to any one of the previous embodiments 1 to 27, whereby the carbonated aqueous liquid is a soda-like beverage.

36. The container according to any one of the previous embodiments 1 to 27, whereby the carbonated aqueous liquid is a cider.

37. The container according to any one of the previous embodiments 1 to 27, whereby the carbonated aqueous liquid is a wine.

38. The container according to any one of the previous embodiments 1 to 27, whereby the carbonated aqueous liquid is a champagne.

39. The container according to any one of the previous embodiments 1 to 27, whereby the carbonated aqueous liquid is a soda.

40. The container according to any one of the previous embodiments 1 to 27, whereby the carbonated aqueous liquid is a carbonated water.

41. The container according embodiment 10, whereby said hydrophobic surface is applied to the whole inner surface of the bottle.

42. The container according to any one of the previous embodiments 1 to 41, whereby such inner surface or inner surface part is hydrophobic or super-hydrophobic by spraying, dipping, or a contact application method.

43. The container according to any one of the previous embodiments 1 to 42, whereby such inner surface or inner surface part is hydrophobic or super-hydrophobic by dipping the bottle neck or part of the bottle neck in a solution containing an hydrophobic or a super-hydrophobic coating compound.

44. The container according to any one of the previous embodiments 1 to 42, whereby such inner surface or inner surface part is rendered hydrophobic or super-hydrophobic by a gas phase application method.

45. The container according to any one of the previous embodiments 1 to 42, whereby such inner surface or inner surface part is rendered hydrophobic or super-hydrophobic by atomic layer deposition method.

46. Use of the container according to any one of the previous embodiments 1 to 45, for inhibiting or prevent gushing when dispensing carbonated aqueous liquid.

47. Use of the container according to any one of the previous embodiments 1 to 45, for inhibiting or prevent gushing when dispensing carbonated beverage.

48. Use of the container according to any one of the previous embodiments 1 to 45, for inhibiting or prevent gushing when dispensing beer like beverage.

49. Use of the container according to any one of the previous embodiments 1 to 45, for inhibiting or prevent gushing when dispensing beer.

DRAWING DESCRIPTION

Brief Description of the Drawings

The present invention will become more fully understood from the detailed description given herein below and the accompanying drawings which are given by way of illustration only, and thus are not limitative of the present invention, and wherein.

DETAILED DESCRIPTION

Figure 1:
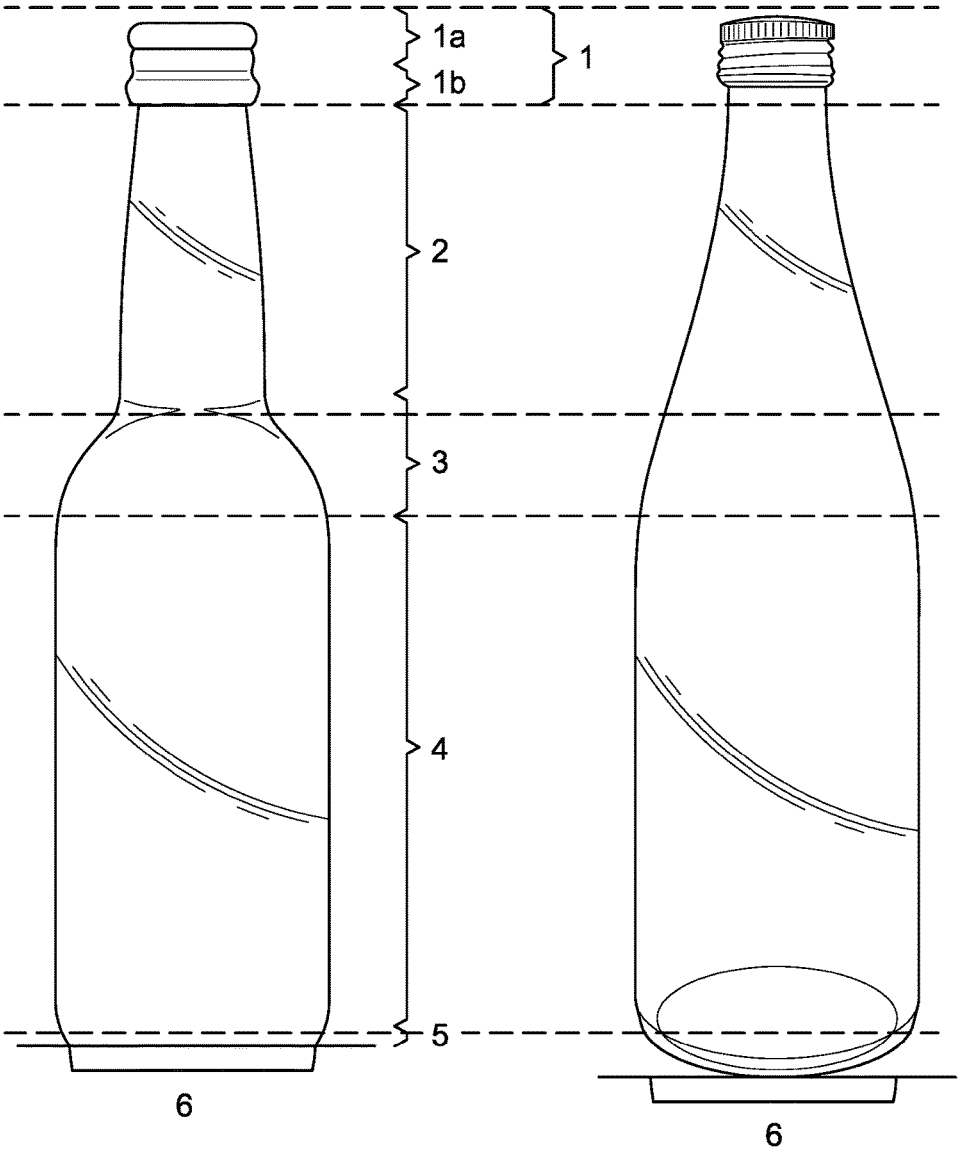
FIG. 1 shows the different parts of the glass bottle: (1) finish, comprising lip (1*a*) and collar (1*b*) (left) or screw (right); (2) neck; (3) shoulder; (4) body; (5) insweep or heel; and (6) base.

Detailed Description of Embodiments of the Invention

The following detailed description of the invention refers to the accompanying drawings. The same reference numbers in different drawings identify the same or similar elements. Also, the following detailed description does not limit the invention. Instead, the scope of the invention is defined by the appended claims and equivalents thereof.

Several documents are cited throughout the text of this specification. Each of the documents herein (including any manufacturer's specifications, instructions etc.) are hereby incorporated by reference; however, there is no admission that any document cited is indeed prior art of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to the devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Other embodiments of the invention will be apparent to those skilled in the art from consideration of the specification and practice of the invention disclosed herein.

It is intended that the specification and examples be considered as exemplary only.

Each and every claim is incorporated into the specification as an embodiment of the present invention. Thus, the claims are part of the description and are a further description and are in addition to the preferred embodiments of the present invention.

Each of the claims set out a particular embodiment of the invention.

The following terms are provided solely to aid in the understanding of the invention.

DEFINITIONS

A bottle comprises hydrophilic material such as glass and comprises different parts as described in FIG. 1: bottle finish (lip/collar), neck, shoulder, body, insweep/heel or base. A bottle is filled with liquid beverages, more in particular carbonated beverages such as beer.

The bottle neck concerns the narrow part of a bottle near the top. The (usually) constricted part of a bottle that lies above the shoulder and below the finish (FIG. 1 left).

The bottle finish concerns everything above the distinctive upper terminus of the neck. It refers to the combination of the lip (upper part) and collar (lower part) of a finish, if both are present, or any other distinct parts if present. For bottles with a screw cap, the bottle finish is the part of the bottle containing the (glass) screw thread (FIG. 1 right).

The shoulder of the bottle concerns the area between the body and the neck of the bottle.

"Locoregional" means limited to a local region of a hydrophilic liquid container, preferably a glass liquid container and "Local" for the present invention refers to a contact at the edge of the surface of the liquid in a bottle being filled with such liquid.

A hydrophobic layer is a layer with a contact angle of at least 64° with water.

Micro-textured or micro-patterned surfaces with hydrophobic asperities can exhibit apparent contact angles exceeding 150° and are associated with superhydrophobicity and the "lotus effect". "Superhydrophobic" used herein refers to a material or surface having a contact angle with water of at least 150 degrees. For example, the superhydrophobic materials disclosed herein could have a contact angle of at least 155 degrees, at least 160 degrees, at least 165 degrees, at least 170 degrees or at least 175degrees.

A thin layer or thin coating used herein refers to a layer or a coating that is less than 3 mm thick, preferably less than 2 mm thick but more than 1 mm.

An ultrathin layer or thin coating used herein refers to a layer or a coating that is preferably less than 1 mm thick, preferably less than 300 μm and most preferably less than 100 μm.

Overfoaming of carbonated liquids such as for example carbonated water, beer, cider, sparkling wine, champagne, soda, as used in disclosing the present invention, means the formation of foam upon a (quick) release of pressure when the bottle is opened whereby if the bottle were not to be poured out directly and left open, part of the formed foam would be spilled over the edge of the bottle.

Gushing of carbonated liquids such as beer is characterised by the fact that immediately after opening a bottle a great number of fine bubbles are created throughout the volume of beer and ascend quickly under foam formation, which flows out of the bottle. It is assumed that the causes of malt-derived gushing are due to the use of "weathered" barley, wheat, or all other types of grains or natural carbohydrate adjuncts (as mash kettle, lautertun and boiling kettle raw materials) and the growth of moulds in the field, during storage and malting. Fungal hydrophobins, hydrophobic components of conidiospores or aerial mycelia, are gushing-inducing factors. Furthermore, increased formation of ns-LTPs (non-specific lipid transfer proteins), synthesised in grains as response to fungal infection, and their modification during the brewing process may be responsible for malt-derived gushing [Hippeli, S, and Elsner, E. F. (2002). *Z. Naturforsch.* 57c, 1-8].

Except for the above-mentioned description of overfoaming and of gushing, the term gushing is used throughout this document both to describe true gushing and to describe true overfoaming while the term overfoaming is used throughout this document both to describe true overfoaming and to describe true gushing.

The terms "carbonic acid" or "carbonated" as used in disclosing the present invention, are used as synonyms for the physicochemical binding of carbon dioxide ($CO_2$) in water (or in beer or in other an alcoholic beverage produced by the saccharification of starch and fermentation of the resulting sugar).

The abbreviation CySH stands for cyclosilicate hydrate.

Figure 2:
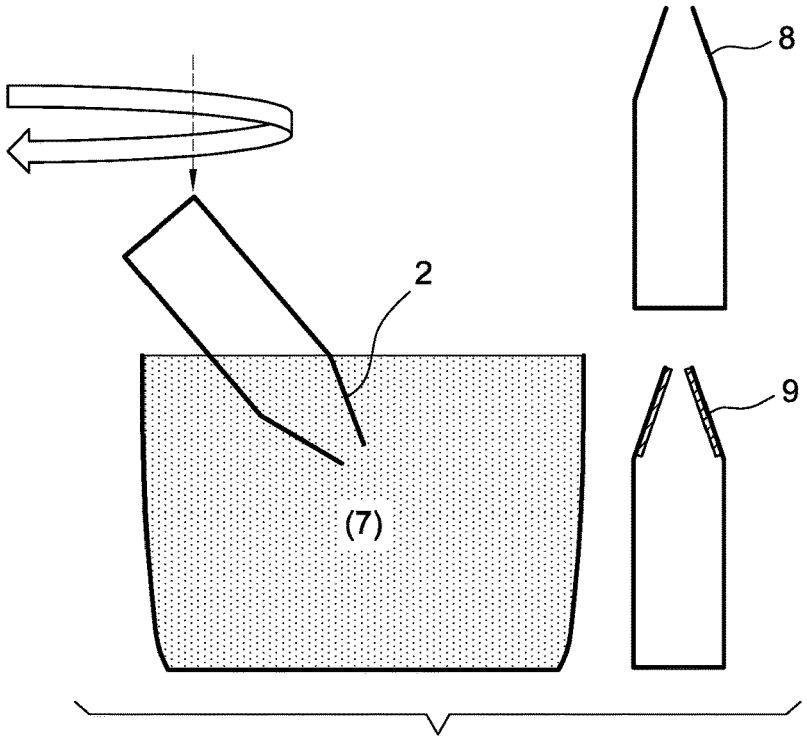
FIG. 2 left panel shows the method of coating the inner surface of the bottle neck with the hydrophobic coating material. The bottle neck of the bottle (2) is immersed and rotated in an aqueous solution containing the hydrophobic coating material (7). The difference in the bottle neck before (8) and after modification (9) is depicted in the right panel.
Figure 3:
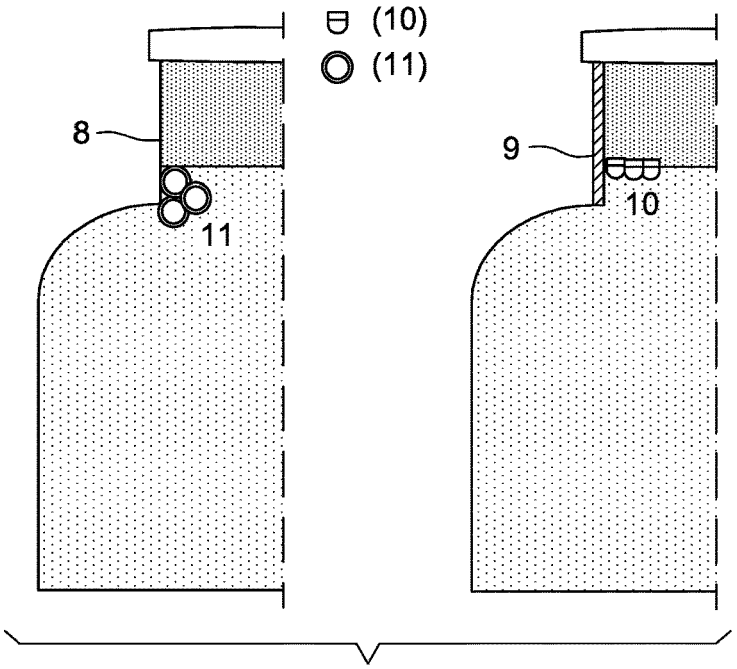
FIG. 3 shows the difference between a hydrophilic bottle (8) and a bottle with hydrophobic coating on the inner surface of the bottle neck (10). In a hydrophilic bottle, nanobubbles (11) are formed due to the presence of hydrophobins (9) in the carbonated liquid, which causes gushing after opening of the bottle. In a bottle coated with a hydrophobic coating material at the bottle neck, no nanobubbles will be formed, and gushing will be prevented.
Figure 4:
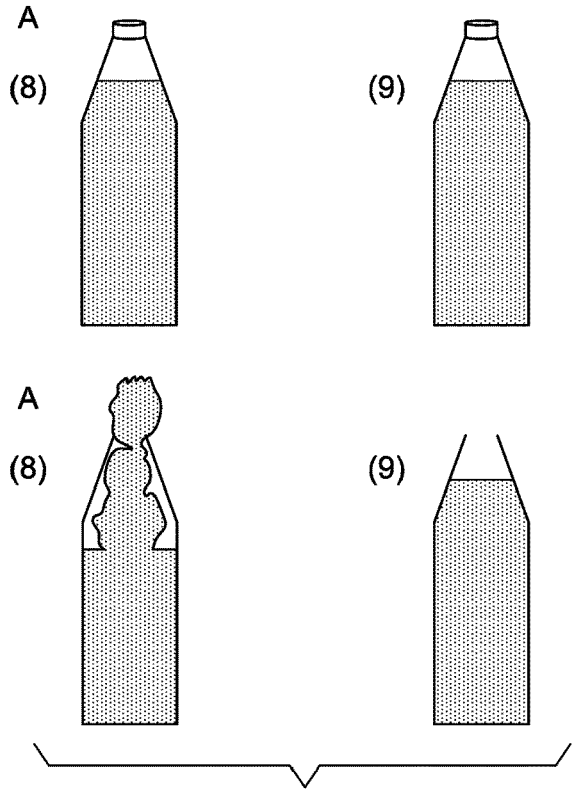
FIG. 4 shows a closed glass bottle (A) and the gushing effect after opening (B) the carbonated liquid containing hydrophilic bottle without hydrophobic coating of the bottle neck (8), as compared to prevention of gushing when opening a hydrophilic bottle of which the bottle neck is coated with hydrophobic coating materials such as polycarbonate coating or GPTMS (9).

The invention relates to a hydrophobic coating of the inner surface of a hydrophilic bottle such as glass bottles for carbonated beverages such as beer, in particular to the hydrophobic coating of the inner surface of the bottle neck of a glass beer bottle (FIG. 1). The invention also relates to a method of applying said hydrophobic coating material to the glass bottle neck (FIG. 2). The hydrophobic coating provides for preventing the interaction between the hydrophilic glass wall and the Class II hydrophobins that induce the formation of the stabilized nanobubbles (FIG. 3), solving the gushing problem when opening the glass bottle containing the carbonated liquid (FIG. 4).

In a preferred embodiment, the coating is applied to the inner surface of the bottle neck. In other embodiments, the coating is extended to the inner surface of the bottle finish (lip/collar), neck, shoulder, body, insweep/heel base, the whole inner surface of the bottle or to the whole surface of the bottle (FIG. 1). In yet other embodiments, the coating can be applied to only a part of the bottle neck inner surface.

The coating of the present invention is applied in the form of a classical hydrophobic material such as for example polymers such as polyoligosiloxysilane, polydimethylsiloxane (PDMS), polydiphenylsiloxane, polymethylphenylsiloxane, polyethylene, poly(vinyl chloride), poly(vinylidene fluoride), and chlorinated polypropylene; and surface treatment agents such as silanes (e.g. glycidyloxypropyltrimethoxysilane (GPTMS) [Sharif S. et al (2011) *Autex Research Journal* 11, 71-77], trimethylchlorosilane, trimethylethoxysilane, trimethylmethoxysilane, dimethyldichlorsilane, dimethyldiethoxysilane, dimethyldimethoxysilane, diacetoxydimethylsilane, highly reactive oligosiloxysilanes and oligosiloxysilanes).

Many silicones, Teflon® and other fluoropolymer coatings are permitted for use in contact with food in compliance with the Federal Food, Drug, and Cosmetic Act and applicable regulations Suitable hydrophobic coatings for present invention include Parylene (poly paraxylylene). It conforms to virtually any shape, including sharp edges, crevices, points; or flat and exposed internal surfaces; it can be applied at the molecular level by a vacuum deposition process at ambient temperature and it in a single operation ultrathin film coatings can be applied. The parylenes are polymers of the p-xylenes and parylene dimer is produced in three variations, each suited to the requirements of a category of applications, Parylene C, Parylene N and Parylene D. Poly-p-xylylene series is Parylene N—a completely linear, highly crystalline material. The other members (C and D) originate from the same monomer and are modified by substitution of one or two aromatic hydrogens with chlorine atoms.

Contact angles of water with a substrate can be measured in different ways leading to different results for our definition of hydrophobic and hydrophilic we will use the average between the receding and the advancing contact angle of a water droplet with a flat surface measured using the dynamic sessile drop method. Contact angles are very dependent on the smoothness of the surface and the history of the sample and can be influenced by small impurities, therefore the contact angles tabulated below should only be considered as examples of possible contact angles for the particular materials. The contact angles with water of smooth surfaces of representative hydrophobic materials are given below:

| | Contact Angles with Water on Smooth Surfaces |
|---|---|
| heptadecafluorodecyltrimethoxysilane* | 115° |
| (heptafluoroisopropoxy)propyltrichlorosilane* | 109-111° |
| poly(tetrafluoroethylene) | 108-112° |
| poly(propylene) | 97-108° |
| chloro(dimethyl)octadecylsilane* | 110° |
| trichloro(octadecyl)silane* | 102-109° |
| chloro(dimethyl)octylsilane* | 104° |
| polydimethylsiloxane | 107.5° |
| tris(trimethylsiloxy)-silylethyldimethylchlorosilane* | 104° |
| dichlorodimethylsilane* | 95-105° |
| butyldimethylchlorosilane* | 100° |
| Parylene ®-D | 97° |
| chlorotrimethylsilane* | 90-100° |
| Poly(ethylene) | 88-103° |
| Poly(styrene) | 87-94° |
| Poly(chlorotrifluroethylene) | 90° |
| Parylene ®-C | 87° |
| poly(vinyl chloride) | 86° |
| Parylene ®-N | 79° |
| Polyethylene terephthalate | 67-95° |
| Glycidoxypropyltrimethoxysilane (GPTMS)* | 64° |

*Contact angles for silanes refer to smooth treated surfaces

In another embodiment of present invention the glass surface of at least a portion of the glass bottle is coated with a resin which is selected from polyurethanes, polyethylene terephthalate, modified epoxy resins, stabilised polyesters and acrylic resins including epoxy acrylates, polyester acrylates, polyether acrylates, for example amine-modified polyether acrylates, acrylic acrylates and urethane acrylates.

In another embodiment of present invention the glass surface of at least a portion of the glass bottle is coated with paraffin, aliphatic alcohol, protein, DNA, polysaccharide, polyethyleneglycol, a lipid, a lipid ester, a long aliphatic fatty acid or a aliphatic fatty acid based ester.

In another embodiment of the present invention the glass surface of at least a portion of the glass bottle is coated with a siloxane polymer, an oligosiloxane polymer or a silicone or is surface treated with a silane, with complete coating of the inner glass surface of the glass bottle being preferred.

In another embodiment of the present invention the glass surface of at least a portion of the glass bottle is coated with a silane with complete coating of the inner glass surface of the glass bottle being preferred.

In yet another embodiment of present invention at least a portion of the glass surface inside of the bottle comprises a hydrophobic coating, fluoro-polymer coating or a parylene coating.

Figure 6:
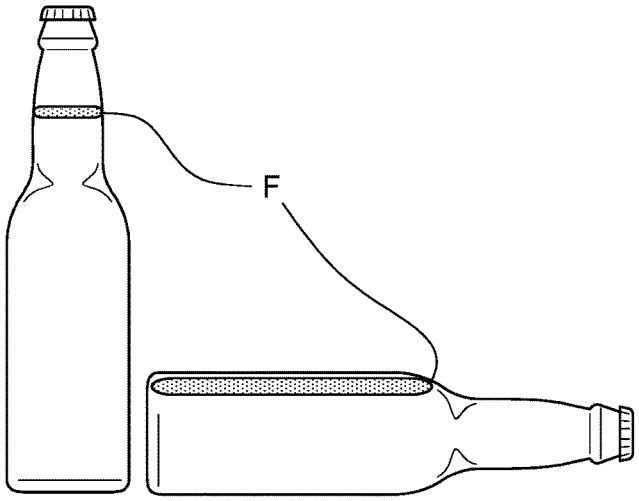
FIG. 6 shows fluid surface edge (F) contacting against the inner wall of a bottle while standing or while lying.

The hydrophobic coating adhering to the bottle surface in the bottle which results in reduced gushing of a carbonated beverage, preferably an alcoholic beverage produced by the saccharification of starch and fermentation of the resulting sugar, when the glass bottle is being opened. In a preferred embodiment the hydrophobic coating is formed within or on surface of the glass inside the bottle on a portion of the internal surface. A standard glass bottle comprises the following parts: (1) finish, comprising lip (1*a*) and collar (1*b*); (2) neck; (3) shoulder; (4) body; (5) insweep or heel; and (6) base (FIG. 1) Optimal antigushing effect is achieved when the hydrophobic thin layer or film or an ultrathin layer or film, when the hydrophobic coating or when the layer of deposited hydrophobic treatment composition is formed within or on surface of the glass of the internal of a bottle covering a part of the neck (2) such that when the bottle is standing on its base or the bottle has its base down (FIG. 6 left) and its finish up that the hydrophobic surface extends above the upper surface of the carbonated beverage, while the hydrophobic surface extends in the (3) shoulder; (4) body direction heel so far that when the bottle is lying (FIG. 6 right) the border of the upper surface of the carbonated beverage is contacting only hydrophobic surface and is not contacting hydrophobic glass surface so that interaction between the hydrophilic glass wall and the Class II hydrophobins is prevented at least in the (3) shoulder or in the neck (2) of the bottle. Other coatings suitable for present invention are fluoropolymer coatings, which may be the synthetic fluoropolymer of tetrafluoroethylene, Polytetrafluoroethylene (PTFE), or another fluorocopolymer or a composite thereof coating which in general are permitted for use in contact with food in compliance with the Federal Food, Drug, and Cosmetic Act and applicable regulations and are suitable for coating of non-metallics such as glass. The U.S. and international regulatory agencies affirmed the safety and reliability of fluoropolymers.

For present invention useful fluoropolymer treatment compositions for coating of the inner surfaces of glass bottles for the purpose of present invention are liquid fluoropolymer composition comprising fluoropolymer selected from homopolymers and copolymers of vinyl fluoride and homopolymers and copolymers of vinylidene fluoride, solvent, and compatible adhesive polymer comprising functional groups selected from carboxylic acid, sulfonic acid, aziridine, amine, isocyanate, melamine, epoxy, hydroxy, anhydride and mixtures thereof. An optional drying process is carried out at a temperature range of less than 200° C. depending on the hydrophobic treatment composition or the to be deposited hydrophobic material, i.e., at least for time sufficient to remove any excess solvent and to produce a hydrophobic coating in a zone on the glass surface in the bottle.

The parylene polymer coatings can be deposited from the vapour phase according to methods in the art. Sublimation under vacuum at approximately 120° C. of the stable crystalline dimer di-p-xylylene, to produce vapours of this material. Pyrolysis of the vapours at approximately 650° C. to form gaseous p-xylylene, the reactive monomer. Deposition and simultaneous polymerization of the p-xylylene to form poly(p-xylylene) or parylene. The coating thickness is determined by the volume of dimer placed in the deposition chamber. Coating thicknesses from 0.10 micron to 76 microns can be applied in a single operation. For the Medical or Food and Beverage Industries, Parylene is FDA approved with a Class VI bio-compatibility rating.

The hydrophobic coating may be applied to the indicated parts of the bottle via spray application, dipping or a contact method. In a preferred embodiment, the hydrophobic coating is immersed in aqueous solution, and the bottle neck is immersed and rotated in a solution, for instance an aqueous solution, containing the hydrophobic coating.

In a preferred embodiment, silane is immersed in organic solution, and the bottle neck is immersed and rotated in a solution, for instance of an organic solution containing silane molecules.

In another preferred embodiment, the bottle neck is immersed in a liquid silane.

In another preferred embodiment, the hydrophobic coating is applied via vapour deposition of silane.

It should be understood that beverages and other beverage products in accordance with this disclosure may have any of numerous different specific formulations or constitutions. The formulation of a beverage product in accordance with this disclosure can vary to a certain extent, depending upon such factors as the product's intended market segment, its desired nutritional characteristics, flavour profile and the like. For example, it will generally be an option to add further ingredients to the formulation of a particular beverage embodiment, including any of the beverage formulations described below. Additional (i.e., more and/or other) sweeteners may be added, flavourings, electrolytes, vitamins, fruit juices or other fruit products, tastents, hops, masking agents and the like, flavour enhancers, ethanol and/or carbonation typically can be added to any such formulations to enhance shelf-life or to vary the taste, mouth feel, nutritional characteristics, colour etc. In general, a beverage in accordance with this disclosure typically comprises at least water, which may be (naturally) carbonated or mineral water, sweetener, acidulant and flavouring. Exemplary flavourings which may be suitable for at least certain formulations in accordance with this disclosure include cola flavouring, citrus flavouring, spice flavourings, apple flavourings, cherry flavourings, raspberry flavourings and others. Carbonation in the form of carbon dioxide may be added for effervescence. Preservatives can be added if desired, depending upon the other ingredients, production technique, desired shelf life, etc. Optionally, caffeine can be added. Certain exemplary embodiments of the beverages disclosed here are cola-flavoured carbonated beverages, characteristically containing carbonated water, sweetener, kola nut extract and/or other cola flavouring, caramel colouring, and optionally other ingredients. Additional and alternative suitable ingredients will be recognized by those skilled in the art given the benefit of this disclosure.

The beverage products disclosed here include beverages, i.e., ready to drink liquid formulations, beverage concentrates and the like. Beverages include, e.g., carbonated and non-carbonated soft drinks, fountain beverages, frozen ready-to-drink beverages, coffee beverages, tea beverages, dairy beverages, powdered soft drinks, as well as liquid concentrates, flavoured waters, enhanced waters, naturally carbonate waters, artificially carbonated waters, fruit juice and fruit juice-flavoured drinks, sport drinks, and alcoholic products, such as beers, ciders, sparkling wine and champagne. The terms "beverage concentrate" and "syrup" are used interchangeably throughout this disclosure. At least certain exemplary embodiments of the beverage concentrates contemplated are prepared with an initial volume of water to which the additional ingredients are added. Full strength beverage compositions can be formed from the beverage concentrate by adding further volumes of water to the concentrate. Typically, for example, full strength beverages can be prepared from the concentrates by combining approximately 1 part concentrate with between approximately 3 to approximately 7 parts water. In certain exemplary embodiments the full strength beverage is prepared by combining 1 part concentrate with 5 parts water. In certain exemplary embodiments the additional water used to form the full strength beverages is carbonated water. In certain other embodiments, a full strength beverage is directly prepared without the formation of a concentrate and subsequent dilution.

Water is a basic ingredient in the beverages disclosed here, typically being the vehicle or primary liquid portion in which the remaining ingredients are dissolved, emulsified, suspended or dispersed. Purified water can be used in the manufacture of certain embodiments of the beverages disclosed here, and water of a standard beverage quality can be employed in order not to adversely affect beverage taste, door, or appearance. The water typically will be clear, colourless, and free from objectionable minerals, tastes and doors, free from organic matter, low in alkalinity and of acceptable microbiological quality based on industry and government standards applicable at the time of producing the beverage. In certain typical embodiments, water is present at a level of from about 80% to about 99.9% by weight of the beverage. In at least certain exemplary embodiments the water used in beverages and concentrates disclosed here is "treated water," which refers to water that has been treated to reduce the total dissolved solids of the water prior to optional supplementation, e.g., with calcium as disclosed in U.S. Pat. No. 7,052,725. Methods of producing treated water are known to those of ordinary skill in the art and include deionization, distillation, filtration and reverse osmosis ("r-o"), among others. The terms "treated water," "purified water,", "demineralized water," "distilled water," and "r-o water" are understood to be generally synonymous in this discussion, referring to water from which substantially all mineral content has been removed, typically containing no more than about 500 ppm total dissolved solids, e.g. 250 ppm total dissolved solids.

Those of ordinary skill in the art will understand that, for convenience, some ingredients are described here in certain cases by reference to the original form of the ingredient in which it is added to the beverage product formulation. Such original form may differ from the form in which the ingredient is found in the finished beverage product. Thus, for example, in certain exemplary embodiments of the natural cola beverage products according to this disclosure, sucrose and liquid sucrose would typically be substantially homogenously dissolved and dispersed in the beverage. Likewise, other ingredients identified as a solid, concentrate (e.g., juice concentrate), etc. would typically be homogenously dispersed throughout the beverage or throughout the beverage concentrate, rather than remaining in their original form. Thus, reference to the form of an ingredient of a beverage product formulation should not be taken as a limitation on the form of the ingredient in the beverage product, but rather as a convenient means of describing the ingredient as an isolated component of the product formulation.

Beer is an alcoholic and carbonated beverage. It is produced on the basis of saccharified starch by fermentation. The starch as source material for beer is obtained from grain (barley, rye, wheat, rice, maize), more rarely from potatoes or, for example, peas. According to the German Reinheitsgebot (Purity Regulations), according to which the breweries in Germany predominantly brew, only water, malt, hops, and yeast may be used for the purpose of producing beer. In all beers, alcohol and, in the vernacular, carbonic acid arises in the course of the fermentation process. Stated more precisely, carbon dioxide ($CO_2$) arises, from which carbonic acid ($H_2CO_3$) is formed. At neutral pH, over 99% of the carbon dioxide binds only physically in water (or in beer). The remainder (less than 1%) forms, considered chemically, carbonic acid ($H_2CO_3$).

Beer comes onto the market in carbonated form. Without the carbonic acid contained in the beer, beer would be unsuitable for consumption and would be classified as unsatisfactory by food-inspection authorities.

In the course of the brewing process, a distinction is made between primary fermentation and secondary fermentation. In the course of the primary-fermentation process, the carbon dioxide ($CO_2$) arising escapes as soon as the $CO_2$ saturation pressure in the liquid has been attained.

In contrast, the carbon dioxide arising in the secondary-fermentation phase is bound in the beer by the fermenting tanks being subjected to a counter-pressure. This is affected, for example, via a bunging apparatus. The latter is an adjustable pressure regulator for the fermentation pressure, for example, 0.5 bar. So long as the internal pressure of the tank is lower than the set counter-pressure, the carbonic acid arising from fermentation is bound in the liquid. $CO_2$ arising over and above that is able to escape through the bunging apparatus. The amount of bound carbonic acid is temperature-dependent and pressure-dependent.

Due to the carbonic acid bound in the beer, the beer contained in a vessel, for example, a cask or bottle is under pressure. On average, in the case of bottom-fermented beer, between 4 g and 6 g $CO_2$ per kg beer is dissolved and, in the case of top-fermented beer, between 4 g and 10 g $CO_2$ per kg beer. Assuming an average concentration of 6 g/kg, the internal pressure of the vessel at 10° C. amounts to 1.6 bar, and, at 30° C., 3.6 bar. In the course of dispensing, the beer casks, so-called "keg casks," are filled with $CO_2$ or another gas with a pressure of up to 3 bar in place of the beer. By reason of the volume of keg casks (typically 20, 30, and 50 liters) and by reason of the maximum pressure (3 bar in the case of beer), the casks are subject to the Druckbehaelterverordnung (German pressure-vessel directive) and have to conform to safety requirements.

Referring to Beer Industry Handbook, 1985 edition; compared with the scale of annual output of 50,000 tons: Traditional fruit-flavour beer is prepared by adding juices, flavours and sugar into common beer, while the beer-like beverage of this fruit-flavoured beer is refined from soybean peptides, high fructose syrup, etc. No malt, saccharification, fermentation or yeast is necessary during the production process of this beer-like beverage. Except for spray sterilization, the production technology is completely different from the traditional way and is a whole new one. For instance US2009/0285965A discloses procedures to make beer like beverage.

There are several means in the art to carbonate an aqueous solution or to dissolve carbon dioxide in an aqueous solution.

One method for carbonating aqueous liquids involves using yeast. In this method, some yeast is added to a sweet sugar-based liquid. The yeast bacteria consume the sugars and produce carbon dioxide as a by-product. This carbon dioxide production continues for a number of days in a warm environment after which it is to be kept refrigerated. This ferment carbonation can result in a $CO_2$ content of about 3 g/L or a bit more depending on the height of the fermentation tank. But additional carbonation by additional or other means is still necessary, in particular for two reasons. Firstly the natural carbonation process during fermentation is not sufficiently reliable or controllable to steer it to a desired and/or predictable end concentration of solved $CO_2$. Secondly a desired end concentration of 5 g/L-7 g/L of dissolved $CO_2$ cannot be reached by this natural fermentation derived carbonation process. A possible physical process of producing carbonated water (water containing carbon dioxide) or other carbonated aqueous liquids can be by passing carbon dioxide under pressure through such water or other aqueous liquid. Thus the process usually involves high pressures of carbon dioxide at a relatively high especially when the system is susceptible to pressure drops, whereby carbon dioxide used for carbonation is compressed carbon dioxide. The solubility of $CO_2$ in water varies according to the temperature of the water and the pressure of the gas. It decreases with increased temperature and increases with increased pressure. At 15.5° C. and a pressure of 1 atm (15 psi), water will absorb its own volume of carbon dioxide. Raising the pressure to 10 atm (150 psi) will bring about an increase in the gas solubility to around 9.5 volumes. Since it is easy it is simpler to carbonate if the product temperature is low early carbonators used refrigeration to carbonate at ca. 4° C. For instance the product is spread over chilled plates, such that the product runs down the plates as a thin film. This is carried out in a constant pressure carbon dioxide atmosphere. The product being chilled as a film maximises the surface area available to the carbon dioxide thus promoting effective carbonation. This energy usage of this process is however high.

Other basic methods use the injection and dispersion of carbon dioxide into the liquid to be carbonated, and the fine spraying of the product into a carbon dioxide atmosphere. For batch production it has been found by experience that the most effective method is to spray the water into a carbon dioxide atmosphere within a pressurised vessel. The rate of flow and the pressure of the carbon dioxide are critical to ensure that the correct carbonation. The greater the liquid surface area exposed to the carbon dioxide the higher the rate of absorption of the carbon dioxide by the liquid. For instance, injection of compressed carbon dioxide into the container or recipient with a watery fluid is described in U.S. Pat. No.6,036,054 or U.S. Pat. No.7,296,508. JP2003112796A describes such for carbonation of a beverage. Recently, many methods for producing carbonated spring by using a membrane have been proposed such as JP2810694 which describes the use of a hollow yarn membrane module incorporating plural porous hollow yarn membranes whose both ends are open and further JP3048499 and JP3048501, JP2001293344A and the like which propose methods of using a nonporous hollow yarn membrane as a hollow yarn membrane. In these systems carbonated water is produced using a membrane, a so- called one-pass type in which carbonated water is produced by passing raw water through a carbon dioxide gas dissolver having a membrane module. The JP2006020985A describes the use of micropore systems in an apparatus for diffusing carbon dioxide in a water volume.

Another method for carbonating liquids includes using dry ice as a source of carbon dioxide. In this method, carbon dioxide is in a solid state, and is placed into the liquid to be carbonated. The carbon dioxide sublimates from a solid to gaseous state, and carbonates the liquid.

Carbonation is particular critical for some beer, for instance the Belgian beer, since for consumer acceptance a reasonable foam head in proper dimensions is required. This is obtainable by the proper concentration of $CO_2$ in said beer. Such beer foam further comprises polypeptides of different groups with different relative hydrophobicity. As the hydrophobicity of the polypeptide groups increases, so does the stability of the foam.

In general the presence of carbon dioxide does make aerated waters and soft drinks both more palatable and visually attractive. The final product sparkles and foams. It give the 'fizz' to carbonated drinks, the cork pop and bubbles in champagne and the head to beer. Consumers tend to place a lot of importance on beer heads: too much of a head is undesirable because it detracts from the mass of the drink (similar to carbonated soda drinks), but on the other hand, a beer drink is viewed as incomplete unless it has a head, and the specific form of head expected for the type of beer.

Moreover the dissolved $CO_2$ is responsible for the flavour. If a beer is not properly saturated with carbonic acid then beer's characteristics of full taste is lacking or a feeling of full taste is not observed by a significant portion of consumers, representatives in a taste panel or beer sommeliers. Moreover above a certain level of carbonation carbon dioxide has a preserving property, having an effective antimicrobial effect against moulds and yeasts.

Methods in practice of beer carbonation are beside the $CO_2$ production and dissolution by the fermentation itself, sparging the $CO_2$ in beer that flows through a guidance pipe. Hereafter the beer/$CO_2$ mixture flow to a series of static mixers to enhance the $CO_2$ dissolution into the liquid. Another common method concerns carbonation of the beer in a closed pressurized container whereby the carbon dioxide is sparged into the liquid the beer mass through a carbonation stone.

Due to its superior transparency and durability glass, for instance conventional soda-lime glass, is a hydrophilic article that is particularly preferred to bottle carbonated beverages such as beer or beer-like beverages.

A particular embodiment of present invention is a glass bottle with an anti-gushing zone for inhibiting or preventing gushing of a carbonated aqueous liquids at opening of said bottle, wherein the antigushing zone is a hydrophobic thin layer, a hydrophobic thin film, an ultrathin hydrophobic layer or an ultrathin hydrophobic film formed within or on surface of the glass of at least part of the internal of a bottle. This antigushing zone can be formed by hydrophobic coating or by treatment with a hydrophobisation agent. Such antigushing zone is but formed within or on surface of glass as fixed layer, coat or film that does not become loose or detach therefrom upon contact with carbonated aqueous liquids under standard storage conditions. It is not a removable plug. The hydrophobic part in the bottle of the present invention is not a removable plug, cap or spout to present liquid dripping during the pouring process. Such plugs can be introduced in a bottle after opening of said bottle to obtain the technical effect of preventing spilling or dripping when the beverage is poured out the bottle for instance into a drinking glass or a drinking cup. The best antigushing effect for bottles that can be stored while standing or while lying is obtained when at least that surface is hydrophobic that contacts the edge of the surface of the stored carbonated beverage. It is for instance sufficient that the antigushing zone extend above and under the surface (border between gas phase and liquid phase). In a particular embodiment of present invention a complete coverage of the inner surface or even the whole glass bottle with an hydrophobic coating, hydrophobic layer or hydrophobic film is used to inhibit or prevent gushing. In a specific embodiment of present invention a complete coverage of the inner surface or even the whole surface of a glass bottle with an hydrophobic coating, hydrophobic layer or hydrophobic film is used to inhibit or prevent gushing.

Optimal antigushing effect is achieved when the hydrophobic thin layer or film or an ultrathin layer or film, when the hydrophobic coating or when the layer of deposited hydrophobic treatment composition is formed within or on surface of the glass of the internal of a bottle is covering a part of the neck (2) such that when the bottle is standing on its base or the bottle has its base down (FIG. 6) and its finish up that the hydrophobic surface extends above the upper surface of the carbonated beverage, while the hydrophobic surface extends in the (3) shoulder; (4) body direction heel such far that when the bottle is lying (FIG. 6) the border of the upper surface of the carbonated beverage is contacting only hydrophobic surface and is not contacting hydrophobic glass surface so that interaction between the hydrophilic glass wall and the Class II hydrophobins is prevented at least in the (3) shoulder or in the neck (2) of the bottle. Other coatings suitable for present invention are fluoropolymer coatings, which may be the synthetic fluoropolymer of tetrafluoroethylene, Polytetrafluoroethylene (PTFE), or another fluorocopolymer or a composite thereof coating which in general are permitted for use in contact with food in compliance with the Federal Food, Drug, and Cosmetic Act and applicable regulations and are suitable for coating of non-metallics such as glass. The U.S. and international regulatory agencies affirmed the safety and reliability of fluoropolymers.

EXAMPLES

Example 1

Hydrophobic Coating of Glass Beer Bottle Neck by Immersion and Rotation

The GPTMS or polyethylene is immersed in aqueous solution. The bottle necks were immersed and rotated in this solution. They were then taken out. After drying at room temperature, the bottles were filled with sparkling water and 10 μg of pure HFBII were added. The bottles were corked and shaken for 3 days in a vertical position at 25° C. at 75 rpm. After shaking, the bottles were left standing for 10 minutes and weighted. They were then opened and the overfoaming volume was determined by the weight reduction. The amount of overfoaming for the different bottles is given in the table below.

| | Coating | Primary Gushing |
|---|---|---|
| Reference bottle | No coating | Positive (>50 mL) |
| Test bottle | GPTMS | Negative (<1 mL) |
| | Polyethylene | Negative (<1 mL) |

The bottle without hydrophobic coating exhibited more than 50 ml of overfoaming, whereas the overfoaming with the coated bottles was less than 1 ml indicating strong inhibition of gushing with the coated bottles.

Example 2

Obtaining a Super Hydrophobic Polycarbonate Surface by One-step Solvent-induced Crystallization US20120142795A describes a one-step method for treating a thermoplastic (e.g. polycarbonate) with solvents to produce hierarchical micro/nano polymer surfaces having selected hydrophobic characteristics and thus to make a surface thereof super hydrophobic. The method includes exposing the thermoplastic to a specific solvent for a selected time period. The treatment time is in the range of one minute to approximately five hours and more preferably in the range of one minute to 15 minutes. Thermoplastics and solvents having a similar solubility parameter interact with one another to form hydrophobic hierarchical surfaces. Hierarchical surfaces are created in smooth polycarbonate treated with dichloromethane to form nano-micro pores on the surface and in polyester with acetone to create hierarchical structures.

Example 3

Hydrophobic Coating of Glass Beer Bottle Neck by Immersion into an Acrylic Treatment Composition (Acrylic Polymer in Water Emulsion which Became Water-resistant Hydrophobic Coating when Dry)

Figure 5:
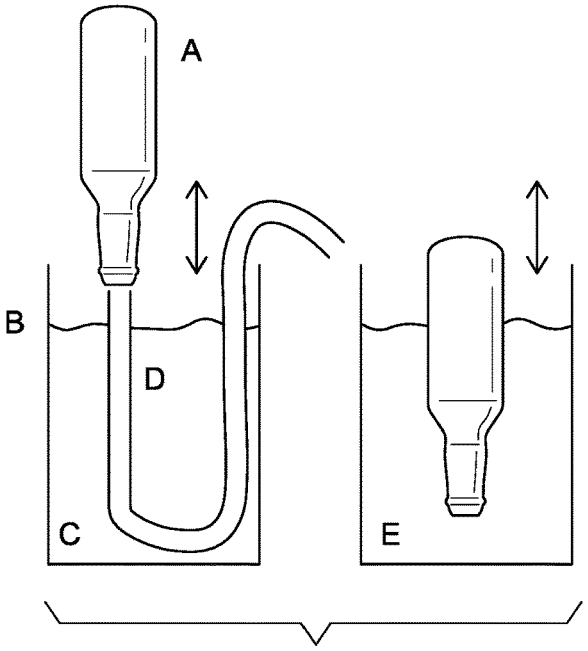
FIG. 5 shows a dipping system for coating of the inner surface of a bottle and cleaning of the outer surface of bottle.

Acrylic resin (Brand Mobihel)-based varnish was used to treat said standard glass beer bottles (Orval Brewery, Belgian trappist brewery located within the walls of the Abbaye Notre-Dame d'Orval in the Gaume region of Belgium) to locoregionally coat the inside of beer bottles. Beer bottles (A) were coated by dipping them in a bath (B) with this acrylic treatment composition (C) and a vent (D) as in FIG. 5 so that the acrylic treatment composition could flow in the bottle. The acrylic treatment composition surface of the bottle could be washed from the outer surface from the bottle by dipping said bottle in a bath with washing fluid (E). Such bottles coated with an inner antigushing zone bottled with carbonated water comprising class II hydrophobins or with carbonated beer comprising class II hydrophobins and consequently stored for at least 15 days have less gushing after opening than the non-coated bottles.

Example 4

Figure 7:
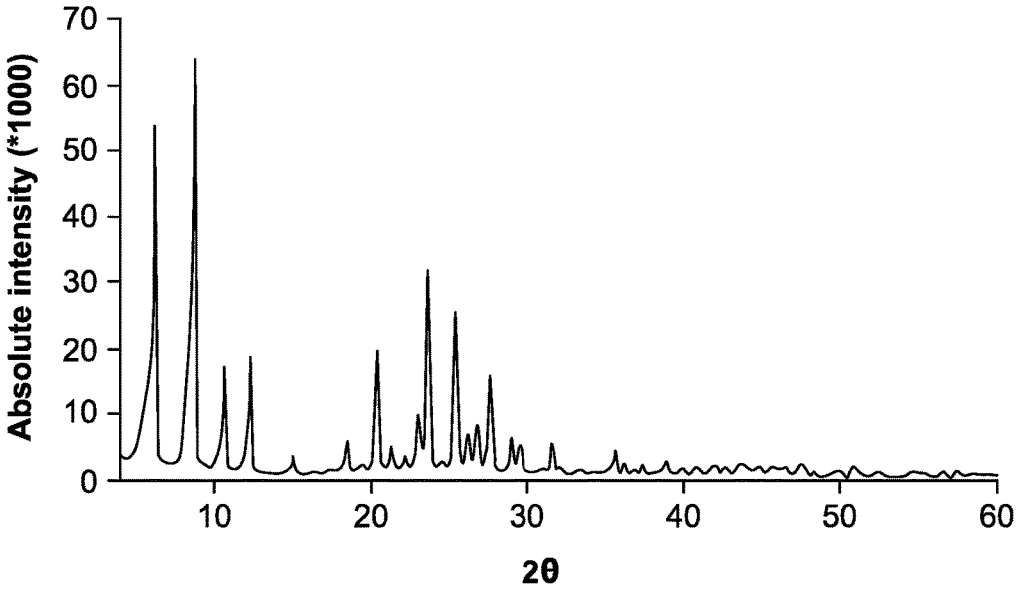
FIG. 7 shows a X-ray diffraction spectrum of TBA-CySH ($NH_3$) crystals

Synthesis of TBA-CySH($NH_3$) Crystals 278 ml of a 40% by weight aqueous solution of tetrabutylammonium hydroxide (TBAOH) and 444 ml of a 25% by weight aqueous solution of ammonia ($NH_3$) were added to a 1 L polypropylene bottle. To this stirred aqueous mixture, 278 ml tetraethyl orthosilicate (TEOS) was added over a period of 90 minutes. This mixture was stirred continuously until crystals were formed. After an additional day of stirring, the mixture was filtered. A white powder is obtained, TBA-CySH($NH_3$) crystals. The structure of the silicate hydrate material was confirmed using X-ray diffraction (XRD) (see FIG. 7).

Example 5

A Suspension of Highly Reactive Oligosiloxysilane Compounds with Dimethyldichlorosilane ($Me_2Cl_2Si$) in an Organic Solution 4 grams of TBA-CySH($NH_3$) crystals from Example 4 were dried under vacuum at room temperature for 48 hours.

Dry tetrahydrofuran (THF) was obtained by suspending dried anhydrous calcium chloride ($CaCl_2$) powder in THF for 48 hours and subsequently partly distilling the suspension. 90 ml of this distillate and 10 ml of dimethyldichlorosilane was added to the dried TBA-CySH($NH_3$) crystals. A white suspension was formed. The suspension was filtered through a 0.2 μm PTFE filter. The filtered solution obtained was a clear transparent solution.

Example 6

A suspension of Highly Reactive Oligosiloxysilane Compounds with Dimethyldichlorosilane ($Me_2Cl_2Si$) in Dichloromethane 4 grams of TBA-CySH($NH_3$) crystals from Example 4 were dried under vacuum at room temperature for 48 hours. Dry tetrahydrofuran (THF) was obtained by suspending dried anhydrous calcium chloride ($CaCl_2$) powder in THF for 48 hours and subsequently partly distilling the suspension. 90 ml of this distillate and 10 ml of dimethyldichlorosilane was added to the dried TBA-CySH ($NH_3$) crystals. A white suspension was formed. 50 ml of the suspension was filtered through a 0.2 μm PTFE filter and subsequently exposed to reduced pressure to remove all volatile compounds until a white powder precipitated. 50 ml of dry dichloromethane was added to this precipitate. A clear solution was obtained.

Example 7

Figure 8:
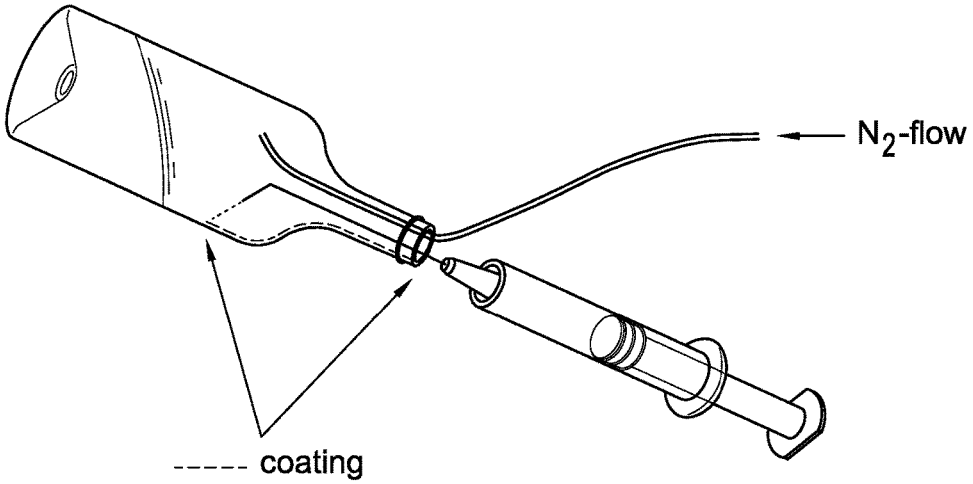
FIG. 8 shows a graphical representation of a potential coating procedure

Synthesis of a Hydrophobic Coating Inside Glass Bottles Using Highly Reactive Oligosiloxysilane Compounds with Dimethyldichlorosilane ($Me_2Cl_2Si$) Suspended in an Organic Solvent Different glass bottles (1 liter bottles from Spa® and 0.33 liter bottles from Duvel®) were thoroughly washed with a mixture of warm water and soap and subsequently rinsed multiple times with ethanol and acetone. The cleaned bottles were dried in an oven at 120° C. for 24 hours. The bottles were coated with 10 ml of the acquired solution from Example 5 by spraying the solution inside the bottle with a syringe with a bent tip while under $N_2$-flow and while turning the bottle around its central axis. (see FIG. 8) The bottles were coated from the opening downwards for roughly 12 centimeters and 7 centimeters for respectively the Spa® bottles and the Duvel® bottles. Since the coating solution from Example 5 still contained unreacted dimethyldichlorosilane and since dimethyldichlorosilane is volatile (bp 70° C.) the bottom part of the bottles is also partially covered with a hydropbobic coating. The bottles of Example 7 are in this way an excellent example of glass bottles whereby the whole inner surface is coated with a hydrophobic material. The coated bottles were then submerged 3 times in dried THF before being allowed to dry in air. After 24 hours, the bottles were rinsed multiple times with water and acetone.

Example 8

Synthesis of a Hydrophobic Coating Inside Glass Bottles Using Highly Reactive Oligosiloxysilane Compounds with Dimethyldichlorosilane ($Me_2Cl_2Si$) Suspended in Dichloromethane Different glass bottles (1 liter bottles from Spa® and 0.33 liter bottles from Duvel®) were thoroughly washed with a mixture of warm water and soap and subsequently rinsed multiple-times with ethanol and acetone. The cleaned bottles were dried in an oven at 120° C. for 24 hours and then coated with 10 ml of the solution of Example 6 by spraying the solution inside the bottle with a syringe with a bent tip while under $N_2$-flow and while turning the bottle around its central axis (see FIG. 8). The bottles were coated from the opening downwards for roughly 12 centimeters and 7 centimeters for respectively the Spa® bottles and the Duve®l bottles. The coated bottles were then submerged 3 times in dried THF before being allowed to dry in air. After 24 hours, the bottles were rinsed multiple times with water and acetone.

Example 9

Reference Samples

Different glass bottles (1 liter bottles from Spa® and 0.33 liter bottles from Duvel®) were thoroughly washed with a mixture of warm water and soap and subsequently rinsed multiple times with ethanol and acetone and dried at 90° C. for 12 hours.

Example 10

Gushing Test with Duvel® Bottles with Duvel® Beer

Figure 9:
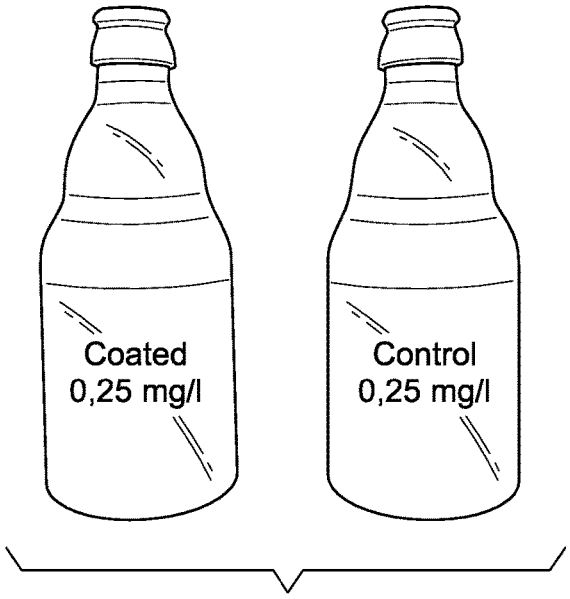
FIG. 9 shows two Duvel® bottles a coated one (left) and a reference bottle without coating (right) each spiked with pure HFBII (concentration 0.25 mg/L). The bottles were corked, stored for three weeks and opened.
Figure 10:
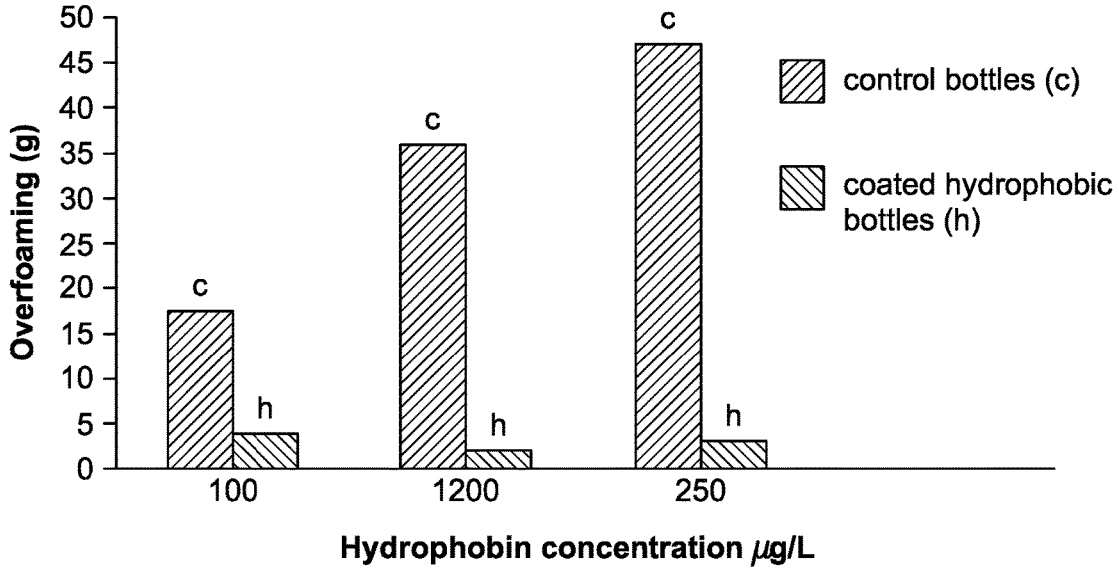
FIG. 10 shows a graphical representation of the weight of beer gushed out of coated and not coated Duvel® bottles spiked with different concentrations of hydrophobins.

Dry Duvel® bottles coated and/or rinsed as described for Examples 7, 8 or 9 were filled with a hydrophobin class II suspension and subsequently filled in line at the Duvel® brewery (Puurs, Belgium) with 330 ml Duvel®. Hydrophobines were added in concentrations of respectively 100 μg/L, 200 μg/L and 250 μg/L. After filling and capping in the brewery, the bottles were stored for three weeks and then opened. Upon opening the overfoaming volume was determined by the weight reduction. The weight reduction of the different bottles is given in Table 1. FIG. 9 shows two opened Duvel® bottles a coated one (left) and a reference bottle without coating (right) each spiked with pure HFBII (concentration 0.25 mg/L). The bottles were filled with Duvel® beer, corked, stored for three weeks and then opened. FIG. 10 shows a graphical representation of the weight of beer which gushed out of the coated and uncoated Duvel® bottles spiked with different concentrations of hydrophobins.

TABLE 1

Overfoaming of Duvel ® in Duvel ® bottles with additional hydrophobin class II
Bottles filled with Beer bottled in the factory (PUURS)

| | Overfoaming (g) | | | | | | |
|---|---|---|---|---|---|---|---|
| Hydrophobin concentration(μg/L) | Control bottles (example 9) | | | Average control | Coated hydrophobic bottles (examples 7 and 8) | | Average coated bottle |
| 100 | 18 | 16 | 17 | 17 | 4 | 4 | 4 |
| 200 | 36 | 39 | 36 | 37 | 2 | 4 | 3 |
| 250 | 45 | 54 | 49 | 49 | 4 | 5 | 5 |

The results in Table 1 show that the control bottles of Duvel® beer spiked with hydrophobin class II without a coating and stored for three weeks overfoamed significantly (>10 mL), whereas coated bottles with the same beer and the same concentration of hydrophobin II stored under identical conditions only slightly overfoam (<5 mL) demonstrating inhibition of gushing.

Example 11

Gushing Test Duvel® Bottles with Sparkling Water

The bottles from Example 10 were rinsed thoroughly with water and filled with sparkling water and hydrophobin at concentrations of 100 μg/L, 200 μg/L and 250 μg/L respectively. After filling the bottles were closed and vertically shaken for 3 days at 25° C. with a stirring speed of 75 rpm. After shaking the bottles were left standing for 10 minutes and weighed. The bottles were then opened and the overfoaming volume was determined by the weight reduction. The weight reduction of the different bottles is given in Table2 as run 1.

The same Duvel® bottles were rinsed again with water and the test with sparkling water and hydrophobin repeated twice. The weight reduction though overfoaming of the different bottles in the second and third runs are given in Table 2 as run 2 and run 3.

TABLE 2

Overfoaming of sparkling water in Duvel ® bottles with additional hydrophobin class II.

| | Bottles filled with sparkling water | | | | | | | |
|---|---|---|---|---|---|---|---|---|
| | Hydrophobin concentration(μg/L) | Control bottles (example 9) | | | Average control | Coated hydrophobic bottles (example 7) | | Average coated |
| run 1 | 100 | 25 | 23 | 28 | 25 | 5 | 5 | 5 |
| | 200 | 44 | 47 | 45 | 45 | 6 | 6 | 6 |
| | 250 | 53 | 55 | 60 | 56 | 12 | 10 | 11 |
| run 2 | 100 | 21 | 26 | 31 | 26 | 4 | 7 | 6 |
| | 200 | 49 | 51 | 40 | 47 | 9 | 12 | 11 |
| | 250 | 51 | 49 | 57 | 52 | 13 | 11 | 12 |
| run 3 | 100 | 28 | 26 | 34 | 29 | 5 | 8 | 7 |
| | 200 | 44 | 48 | 63 | 52 | 9 | 10 | 10 |
| | 250 | 52 | 61 | 48 | 54 | 12 | 14 | 13 |

The results in Table 2 show that the control bottles of Duvel® filled with sparkling water and spiked with hydrophobin class II without a coating and shaken vertically for 3 days at 75 rpm overfoamed considerably (>20 mL), whereas coated bottles with the same type of sparkling water, the same concentration of hydrophobin II and the same treatment exhibited a reduction in overfoaming of greater than 66%. Coated bottles spiked with 100 μg/L only overfoamed slightly (5-7 mL) compared with 25-29 mL overfoaming for uncoated bottles, thereby demonstrating significant inhibition of gushing.

Example 12A

Gushing Test Spa® Bottles with Spa® Sparkling Water with Hydrophobins

Dry Spa® bottles coated and/or rinsed as described for Examples 7, 8 or 9 were filled with a hydrophobin class II suspension and subsequently filled with 1 L Spa sparkling water with a $CO_2$ concentration of about 7 g:L. Hydrophobins were added in concentrations of respectively 50 μg/L, 100 μg/L and 150 μg/L. After filling and closing, the bottles were horizontally shaken for 3 days at 25° C. with a stirring speed of 115 rpm. After shaking the bottles were left standing for 10 minutes and weighed. The bottles were then opened and the overfoaming volume was determined by the weight reduction. The weight reduction of the different bottles is given in Table 3 as run 1.

Example 12B

Gushing Test SPA® Bottles with SPA® Sparkling Water with Hydrophobins

The bottles from Example 12A were rinsed thoroughly with water and filled with sparkling water and hydrophobin at a concentration of respectively 50 μg/L, 100 μg/L and 150 μg/L. After filling the bottles were closed and horizontally shaken for 3 days at 25° C. with a stirring speed of 115 rpm. After shaking the bottles were left standing for 10 minutes and weighed. The bottles were then opened and the overfoaming volume was determined by the weight reduction. The weight reduction of the different bottles is given in Table3 as run 2.

The same SPA® bottles were rinsed again with water and this test with sparkling water and hydrophobin was repeated once more. The weight reduction though overfoaming of the different bottles run is given in Table 3 as run 3.

Example 12C

Gushing Test Spa® Bottles with Spa® Sparkling Water with Higher Concentrations of Hydrophobines The bottles from Example 12B were rinsed thoroughly with water and filled with sparkling water and hydrophobin at a concentration of respectively 100 μg/L, 200 μg/L and 300 μg/L. After filling the bottles were closed and horizontally shaken for 3 days at 25° C. with a stirring speed of 115 rpm. After shaking the bottles were left standing for 10 minutes and weighed. The bottles were then opened and the overfoaming volume was determined by the weight reduction. The weight reduction of the different bottles is given in Table3 as run 4.

The same SPA® bottles were rinsed again with water and this test with sparkling water and hydrophobin was repeated two more times. The weight reduction though overfoaming of the different bottles in the second and third repeat run are given in Table 3 as run 5 and run 6.

TABLE 3

Overfoaming of sparkling water in Spa ® bottles with additional hydrophobin class II, shaken horizontally. Horizontally shaken during 3 days at 115 rpm

| | SPA water bottles 7 g/L $C0_2$ | | | | | | | |
|---|---|---|---|---|---|---|---|---|
| | | Overfoaming (g) | | | | | | |
| | Hydrophobin concentration(μg/L) | Control bottles (example 9) | | | Average control | Coated hydrophobic bottles (example 7 and 8) | | Average coated bottle |
| Run 1 | 50 | 76 | 69 | 73 | 73 | 0 | 0 | 0 |
| | 100 | 158 | 169 | 160 | 162 | 0 | 0 | 0 |
| | 150 | 216 | 221 | 219 | 219 | 1 | 4 | 3 |
| Run 2 | 50 | 75 | 69 | 74 | 73 | 0 | 0 | 0 |
| | 100 | 165 | 167 | 163 | 165 | 0 | 0 | 0 |
| | 150 | 213 | 218 | 210 | 214 | 5 | 3 | 4 |

TABLE 3-continued

| Overfoaming of sparkling water in Spa ® bottles with additional hydrophobin class II, shaken horizontally. Horizontally shaken during 3 days at 115 rpm | | | | | | | | |
|---|---|---|---|---|---|---|---|---|
| | SPA water bottles 7 g/L $C0_2$ | | | | | | | |
| | | Overfoaming (g) | | | | | | |
| | Hydrophobin concentration(μg/L) | Control bottles (example 9) | | | Average control | Coated hydrophobic bottles (example 7 and 8) | | Average coated bottle |
| Run 3 | 50 | 78 | 67 | 90 | 78 | 0 | 0 | 0 |
| | 100 | 172 | 156 | 164 | 164 | 0 | 0 | 0 |
| | 150 | 221 | 245 | 250 | 239 | 3 | 0 | 2 |
| Run 4 | 100 | 171 | 167 | 186 | 175 | 0 | 0 | 0 |
| | 200 | 399 | 376 | 387 | 387 | 5 | 3 | 4 |
| | 300 | 504 | 499 | 510 | 504 | 457 | 489 | 473 |
| Run 5 | 100 | 172 | 158 | 167 | 166 | 0 | 0 | 0 |
| | 200 | 388 | 401 | 367 | 385 | 20 | 12 | 16 |
| | 300 | 501 | 479 | 468 | 483 | 498 | 479 | 489 |
| Run 6 | 100 | 156 | 178 | 164 | 166 | 0 | 0 | 0 |
| | 200 | 399 | 376 | 387 | 387 | 23 | 13 | 18 |
| | 300 | 478 | 488 | 491 | 486 | 415 | 499 | 457 |

The results in Table 3 show that the control bottles of Spa® filled with sparkling water and spiked with hydrophobin class II without a coating and shaken horizontally for 3 days at 115 rpm overfoamed very considerably (>50 mL), whereas coated bottles with the same type of sparkling water, the same concentration of hydrophobin II and the same treatment exhibited a reduction in overfoaming of greater than 90%. Coated bottles spiked with up to 100 μg/L did not overfoam compared with 73-175 mL overfoaming for uncoated bottles, thereby demonstrating prevention of gushing. Coated bottles spiked with 200 μg/L exhibited overfoaming of 0 to 18 mL compared with 376-399 mL overfoaming for uncoated bottles, thereby demonstrating very considerable inhibition of gushing. At extremely high concentrations of hydrophobins (300 μg/L) Spa® bottles filled with sparking water subjected to horizontal shaking overfoamed very considerably i.e. above 400 mL for both coated and non-coated bottles.

Example 12D

Gushing Test Spa® Bottles with Spa® Sparkling Water with Hydrophobines Shaking Vertically The bottles from Example 12C were rinsed thoroughly with water and filled with sparkling water and hydrophobin at a concentration of respectively 50 μg/L, 100 μg/L and 150 μg/L. After filling the bottles were closed and vertically shaken for 3 days at 25° C. with a stirring speed of 115 rpm. After shaking the bottles were left standing for 10 minutes and weighed. The bottles were then opened and the overfoaming volume was determined by the weight reduction. The weight reduction of the different bottles are given in Table 4 as run 7.

The same Spa® bottles were rinsed again with water and this test with sparkling water and hydrophobin was repeated one more time. The weight reduction though overfoaming of the different bottles in this run is given in Table 4 as run 8.

Example 12E

Gushing Test Spa® Bottles with Spa® Sparkling Water Shaking Vertically with Higher Concentration Hydrophobines The bottles from Example 12D were rinsed thoroughly with water and filled with sparkling water and hydrophobin at a concentration of respectively 100 μg/L, 200 μg/L and 300 μg/L. After filling the bottles were closed and vertically shaken for 3 days at 25° C. with a stirring speed of 115 rpm. After shaking the bottles were left standing for 10 minutes and weighed. The bottles were then opened and the overfoaming volume was determined by the weight reduction. The weight reduction of the different bottles is given in Table 4 as run 9.

The same Spa® bottles were rinsed again with water and this test with sparkling water and hydrophobin was repeated once more. The weight reduction through overfoaming of the different bottles in this run is given in Table 4 as run 10.

TABLE 4

| Overfoaming of sparkling water in Spa ® bottles with additional hydrophobin class II, shaken vertically. Vertically shaken during 3 days at 115 rpm | | | | | | | | |
|---|---|---|---|---|---|---|---|---|
| | SPA water bottles 7 g/L $C0_2$ | | | | | | | |
| | | Overfoaming (g) | | | | | | |
| | Hydrophobin concentration(μg/L) | Control bottles (example 9) | | | Average control | Coated hydrophobic bottles (example 7 and 8) | | Average coated bottle |
| Run 7 | 50 | 40 | 45 | 49 | 45 | 0 | 0 | 0 |
| | 100 | 75 | 77 | 80 | 77 | 0 | 0 | 0 |
| | 150 | 99 | 104 | 107 | 103 | 0 | 0 | 0 |
| Run 8 | 50 | 44 | 39 | 36 | 40 | 0 | 0 | 0 |
| | 100 | 71 | 68 | 76 | 72 | 2 | 0 | 1 |
| | 150 | 90 | 86 | 98 | 91 | 3 | 0 | 2 |
| Run 9 | 50 | 49 | 51 | 39 | 46 | 0 | 0 | 0 |
| | 100 | 69 | 66 | 59 | 65 | 4 | 0 | 2 |
| | 150 | 97 | 107 | 108 | 104 | 0 | 1 | 1 |
| Run 10 | 100 | 64 | 71 | 59 | 65 | 2 | 0 | 1 |
| | 200 | 108 | 107 | 99 | 105 | 0 | 0 | 0 |
| | 300 | 189 | 143 | 167 | 166 | 98 | 96 | 97 |

The results in Table 4 show that the control bottles of Spa® filled with sparkling water and spiked with hydrophobin class II without a coating and shaken vertically for 3 days at 115 rpm overfoamed considerably (>30 mL), whereas coated bottles with the same type of sparkling water, the same concentration of hydrophobin II and the same treatment exhibited a reduction in overfoaming of greater than 90%. Coated bottles spiked with 100 μg/L barely overfoamed with overfoaming of 0-2 mL compared with 40-71 mL overfoaming for uncoated bottles, thereby demonstrating almost complete inhibition of gushing. At extremely high concentrations of hydrophobins (300 μg/L) both coated and non-coated bottles overfoamed considerably i.e. above 90 mL, but coated bottles overfoamed 50 percent less (96-98 mL) than non-coated bottles (143-189 mL).

The invention claimed is:

1. A glass bottle comprising a neck, a shoulder and a body; a sealable opening at the end of or above the neck and comprising optionally a finish, wherein the bottle comprises a hydrophobic layer, coating or film, formed within or on a surface of the glass of at least in part the inner surface of the neck or shoulder of the bottle, said hydrophobic layer, coating or film, constituting an anti-gushing zone, inhibiting or preventing a gushing of a carbonated aqueous liquid when or at opening of said bottle filled with said carbonated aqueous liquid, that part of said hydrophobic layer, coating or film contactable with a surface of said carbonated aqueous liquid constituting an anti-gushing zone wherein the anti-gushing zone within or on the surface of the glass inside the bottle of the present invention does not cover the entire inner surface of the glass bottle, wherein the bottle is filled with a carbonated alcoholic beverage comprising living yeast.

2. The glass bottle according to claim 1, wherein the anti-gushing zone within or on the surface of the glass inside the bottle is in such portion of the inner bottle surface such that in the closed bottle, filled with carbonated beverage while standing or while lying, at least that part of the surface is hydrophobic which contacts the edge of the surface of the stored carbonated beverage.

3. The glass bottle according to claim 1, wherein the finish of said bottle does not comprise the anti-gushing zone.

4. The glass bottle according to claim 1, wherein the hydrophobic zone is localized so that when the container is filled by the carbonated aqueous liquid, the edge of the liquid surface contacts the hydrophobic zone and the hydrophobic zone is at least 5 mm above the edge of the liquid surface and at least 5 mm under the edge of the liquid surface.

5. The glass bottle according to claim 1, wherein the hydrophobic zone is localized so that when the container is filled by the carbonated aqueous liquid, the edge of the liquid surface contacts the hydrophobic zone and the hydrophobic zone is less than 2 cm above the edge of the liquid surface and at least 5 mm under the edge of the liquid surface.

6. The glass bottle according to claim 1, wherein the hydrophobic zone is localized so that when the container is filled by the carbonated aqueous liquid, the edge of the liquid surface contacts the hydrophobic zone and the hydrophobic zone is at least 1 cm above the edge of the liquid surface and at least 1 cm under the edge of the liquid surface.

7. The glass bottle according to claim 1, wherein the hydrophobic zone is localized at least 1 cm under the cap of the bottle.

8. The glass bottle according to claim 1, wherein the anti-gushing zone or the hydrophobic zone comprises polyethylene, poly(vinyl chloride), poly(vinylidene fluoride) or chlorinated polypropylene or surface treatment with glycidyloxypropyl-trimethoxysilane.

9. The glass bottle according to claim 1, wherein the anti-gushing zone or the hydrophobic zone comprises polydialkylsiloxane, polyalkylsiloxane, poly-diphenylsiloxane or polymethylphenylsiloxane; or surface treatment with dialkyldichlorosilane, alkyldichlorosilane, highly reactive oligosiloxysilane, oligosiloxysiloxane, polydimethylsiloxane, dimethyldimethoxysilane, dimethyl-dichlorosilane or diacetoxydimethylsilane.

10. The glass bottle according to claim 1, wherein the carbonated alcoholic beverage comprising living yeast is a beer.

11. The glass bottle according to claim 10, wherein the carbonated alcoholic beverage comprising living yeast is a top-fermented beer.

12. The glass bottle according to claim 1, wherein the carbonated alcoholic beverage comprising living yeast is a sparkling wine or champagne.

13. The container according to claim 1, wherein said inner hydrophobic zone is manufactured in the bottle by a spraying, a dipping, or a contact application method.

14. The container according to claim 1, wherein said inner hydrophobic zone obtainable by dipping said finish, neck or shoulder in a solution containing a hydrophobic coating or in a hydrophobic treatment liquid over a vent to achieve inflow of said solution or liquid into the bottle.

15. The glass bottle according claim 1, wherein the anti-gushing zone comprises a hydrophobic thin layer, a hydrophobic thin film, an ultrathin hydrophobic layer or an ultrathin hydrophobic film formed within or on the surface of the glass of at least part of the internal surface of said bottle.

16. The glass bottle according to claim 1, wherein the anti-gushing zone can be formed by the hydrophobic coating or by a layer of deposited hydrophobic treatment composition.

17. The glass bottle according to claim 1, wherein the anti-gushing zone is formed within or on the surface of the glass as a fixed layer, a fixed coat or a fixed film.

18. The glass bottle according to claim 17, wherein the fixed anti-gushing zone formed is not loosenable or is not detachable and is not a removable, not a re-introducible or not a replaceable plug, sprout, crown, cap or stem, for instance to prevent liquid dripping during a pouring action into a cup.

* * * * *